United States Patent [19]

Anderson et al.

[11] 4,004,400

[45] Jan. 25, 1977

[54] ARTICLE WRAPPING MACHINE

[75] Inventors: Ralph F. Anderson; Leo Strombeck, both of Rockford, Ill.

[73] Assignee: Ralph F. Anderson, Rockford, Ill.

[22] Filed: Jan. 2, 1976

[21] Appl. No.: 645,949

[52] U.S. Cl. ..... 53/182 R; 53/202

[51] Int. Cl.[2] ..... B65B 9/06

[58] Field of Search ..... 53/28, 177, 178, 180 R, 53/182 R, 202; 156/515, 497

[56] References Cited

UNITED STATES PATENTS

| | | | |
|---|---|---|---|
| 2,587,422 | 2/1952 | Wills | 156/497 |
| 3,045,405 | 7/1962 | Anderson et al. | 53/182 R |
| 3,344,581 | 10/1967 | Anderson | 53/177 |
| 3,693,319 | 9/1972 | Hunsader | 53/180 X |
| 3,775,222 | 11/1973 | Aspin et al. | 156/497 |

*Primary Examiner*—Robert Louis Spruill
*Attorney, Agent, or Firm*—Morsbach & Pillote

[57] ABSTRACT

A machine for wrapping articles in an elongated strip of wrapping material of the type in which the machine forms the strip into a channel as the strip is advanced past the loading station, articles are deposited in the strip at the loading station, and the strip is folded into a tube around the articles and longitudinally sealed as the strip is advanced past a longitudinal sealing station, and the strip is thereafter transversely sealed between the articles and severed to form separate packages. The machine has endless type upper and lower jaw conveyors which are operated to grip and advance the strip through a selectively adjustable distance and seal and sever the strip to form packages of selectively adjustable lengths. The machine also includes an improved endless type of inlet conveyor which is operative to grip the enfolded strip of wrapping material at opposite sides of the article to hold the articles in position in the wrapping material as it is advanced. The machine is also adjustable to handle articles of different widths.

33 Claims, 27 Drawing Figures

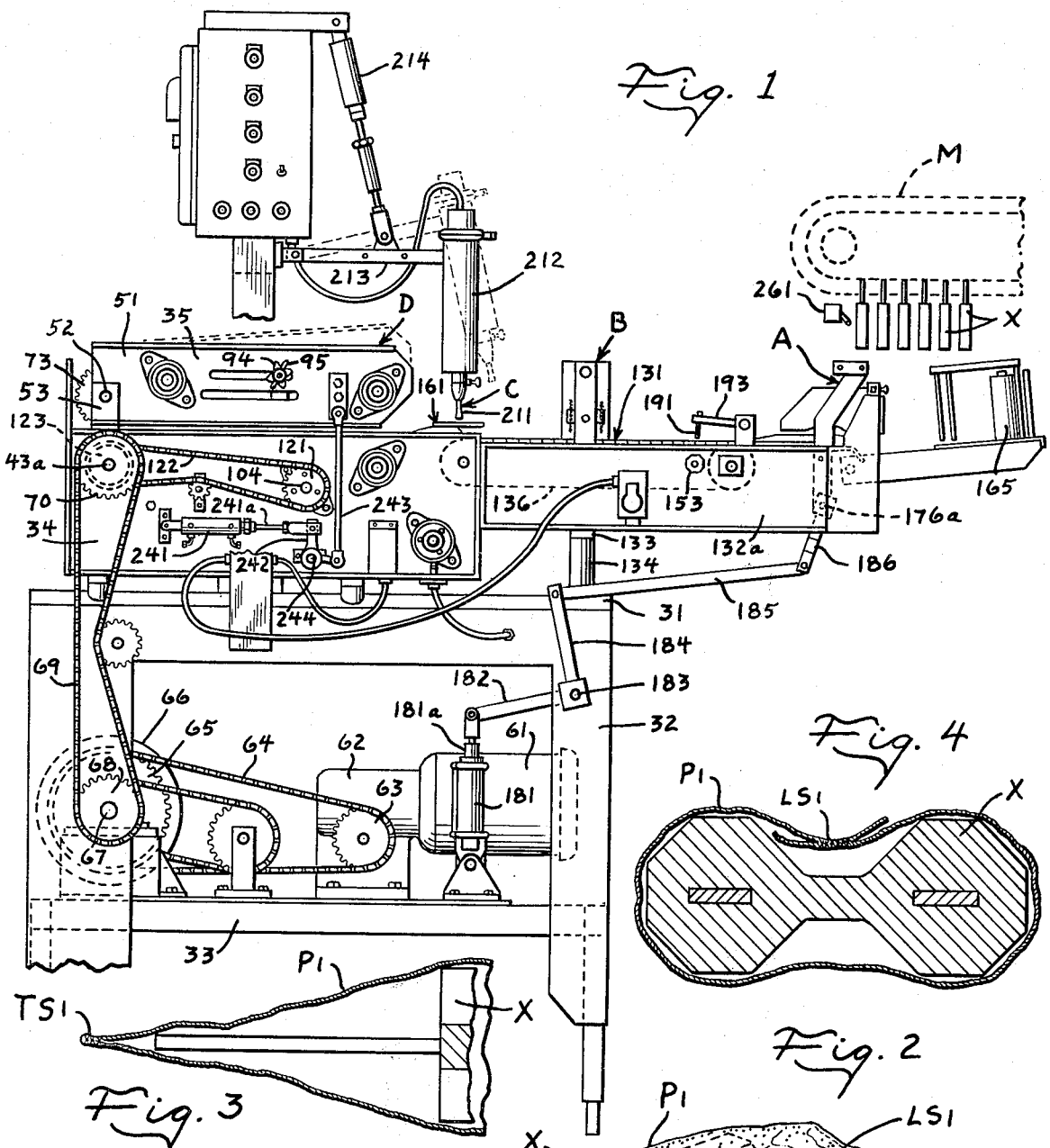
Fig. 1
Fig. 4
Fig. 3
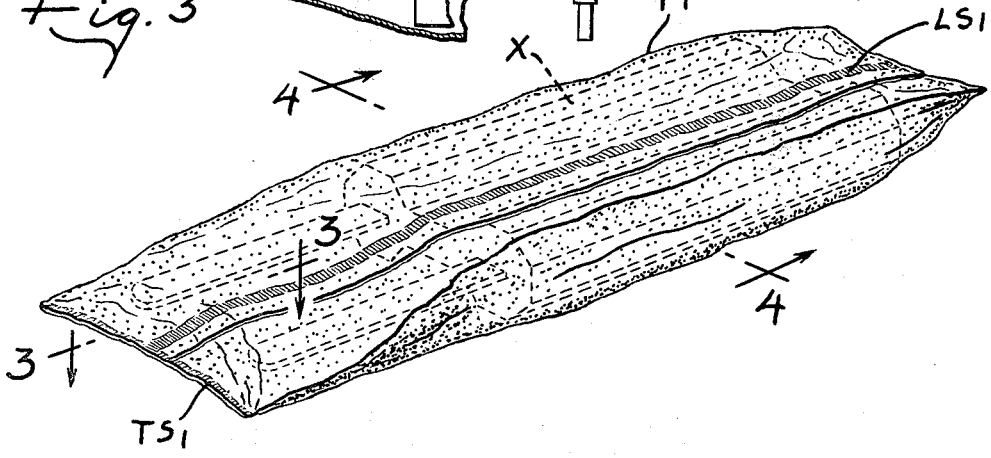
Fig. 2

137a
45a
51a
48
P1
X
57
84
89
47
88a
88
D
91
92
12
X'
101
117
103
121
122
106
105
104
102
38a
107
215
161b
161
161a
83a
82a
55
55a
86
82
93
51
95
94
56
56a
43a
43
31
8

W
A
B
X
10
11
174
175a
175b
173
171a
172
171b
170a
170b
167
166a
166b
165
169
169a
169b
194
193
138
138a
145
136
137
137a
38a
38
132
132a
131
141
141a
141b
141c
142
142a
142b
142c
146
146a
146b
149
149b
149c
149d
148
148b
148c
148d
151
151a
152
152a
153
191
192
143
201a
201b
202
203a
203b
206
161

W
165
166b
167
194
197
196
193
191
195a
195
137a
155
158
157
156
45c
104
122
76
56a
75
74
73
52
72
43a
175a
170a
174
171b
171a
X
175b
176
168a
168b
176a
186
169
A
168c
168
142b
194
193
192
191
151a
138
138a
132
131
151
151b
W
206
207
201a
202
B
201b
152
152a
136
137
C
211
215
161
137a
142b
38a
133
134
31

15
15
A
B'
C'
W
X
165
166a
166b
167
174
170a
172
170b
173
171b
171a
175a
175b
168a
169b
169
169a
194
193
132
138a
232
191
233
236
235
143
142a
142
141
141a
141b
142b

A
B'
C'
W
X
165
166b
167
174
171b
171a
170a
175a
175b
176
176a
168a
168b
168c
168
186
169
142b
194
193
192
191
138
138a
232
233
236
151a
151
151b
132
133
134
235
131
136
152
152a
137a
137
38a
215
161

ARTICLE WRAPPING MACHINE

BACKGROUND OF THE INVENTION

It has heretofore been proposed to make an article wrapping machine in which articles are deposited on a strip of wrapping material at a loading station, the strip enfolded into a tube and longitudinally sealed as the strip is advanced, and the enfolded tube thereafter transversely sealed between the articles in the tube and severed to form separate packages. U.S. Pat. No. 2,918,769 discloses a wrapping machine of this type having a reciprocating jaw mechanism for transversely sealing and severing the enfolded tubes between the articles. Such machines were not entirely satisfactory since it was difficult to hold the articles in proper position within the enfolded tube during the return stroke of the jaws. In addition, some problems were presented in supporting the enfolded wrapper during and after transverse sealing and severing of the wrapper.

It has also been proposed as disclosed in U.S. Pat. No. 3,045,405 to make an article wrapping machine in which endless type upper and lower jaw conveyors were operative to grip the enfolded tube between the articles and to advance the tube a distance corresponding to the pitch distance of the jaws on the upper and lower conveyors. That wrapping machine, however, could only form packages having a length corresponding to the pitch distance of the clamping jaws on the upper and lower jaw conveyors, and the machine could not be adjusted to forming packages of different lengths.

SUMMARY OF THE INVENTION

The present invention relates to a machine for wrapping articles in an elongated strip of wrapping material and for sealing and severing the strip between adjacent articles to form separate packages, which machine is of a type that has a mechanism for forming the strip into a channel as the strip is advanced past a loading station, for depositing articles on the strip at the loading station, for folding the strip into a tube around the articles and for sealing the edges of the enfolded tube as the strip is advanced past the longitudinal sealing station, and for transversely sealing and severing the enfolded tube between the articles to form separate packages.

An important object of this invention is to provide an article wrapping machine of a type described and which is readily adjustable to form packages of different lengths.

Still another object of this invention is to provide an article wrapping machine of the type described which positions and maintains articles in proper position within the strip of wrapping material as the latter is advanced to the machine.

Still another object of this invention is to provide a machine for wrapping articles of the type described and which is adapted for wrapping articles in widely different types of wrapping material including coated wrapping material such as paper and foil having a heat sealable coating, and heat sealable plastic film.

Still another object of this invention is to provide an article wrapping machine of the type described and which is also adjustable to form packages of different widths.

One aspect of the present invention resides in the provision of an article wrapping machine of the type described above in which the upper and lower jaw assemblies for transversely gripping the tube and for advancing the wrapper therewith are mounted on endless type upper and lower conveyors and spaced apart therealong a pitch distance greater than the length of the maximum size package to be formed, with a main drive means operable to drive the upper and lower jaw conveyors through the drive cycle to advance the upper and lower jaw assemblies at the same linear speed along the adjacent runs thereof to a distance equal to the pitch of the jaws along the endless conveyors, and adjustably presettable jaw operating means operative to press the opposed pairs of upper and lower jaw assemblies into clamping engagement with the enfolded wrapper during a preset portion of the drive cycle as they advance along the adjacent runs of the upper and lower jaw conveyors a preset distance substantially less than the pitch distance to clamp the enfolded wrapper therebetween and advance the wrapper therewith a distance corresponding to the preset distance, and to thereafter release the jaw assemblies from clamping engagement with the enfolded wrapper to interrupt advance of the same. The enfolded wrapper is advantageously transversely severed and sealed at opposite sides of the line of severance while the tube is clamped between the opposed pairs of upper and lower jaw assemblies.

Another aspect of the present invention resides in the provision of an article wrapping machine of the type described above and having an endless type inlet conveyor for advancing the strip of wrapping and articles thereon from the loading station to the transverse sealing station and in which the endless inlet conveyor has first and second sets of slats arranged in alternate succession and mounted for limited movement in a direction crosswise of the inlet conveyor, with the slats of the first and second sets respectively having first and second clamp members extending transverse thereto for engaging the strip of wrapping material at relatively opposite sides of the articles therein, and mechanism for relatively moving the slats to clamp strips against the articles as they advance along at least a portion of the upper run of the inlet conveyor.

These, together with other objects, features and advantages of the present invention will be more readily understood by reference to the following detailed description, when taken in connection with the accompanying drawings wherein:

FIG. 1 is a side elevational view of the machine adapted for wrapping articles in strips of heat sealable plastic material;

FIG. 2 is a perspective view of a package of heat sealable plastic material which can be formed on the machine of FIG. 1;

FIG. 3 is a fragmentary longitudinal sectional view through the package taken on the plane 3—3 of FIG. 2;

FIG. 4 is a transverse sectional view taken on the plane 4—4 of FIG. 2;

Figures 5, 7:
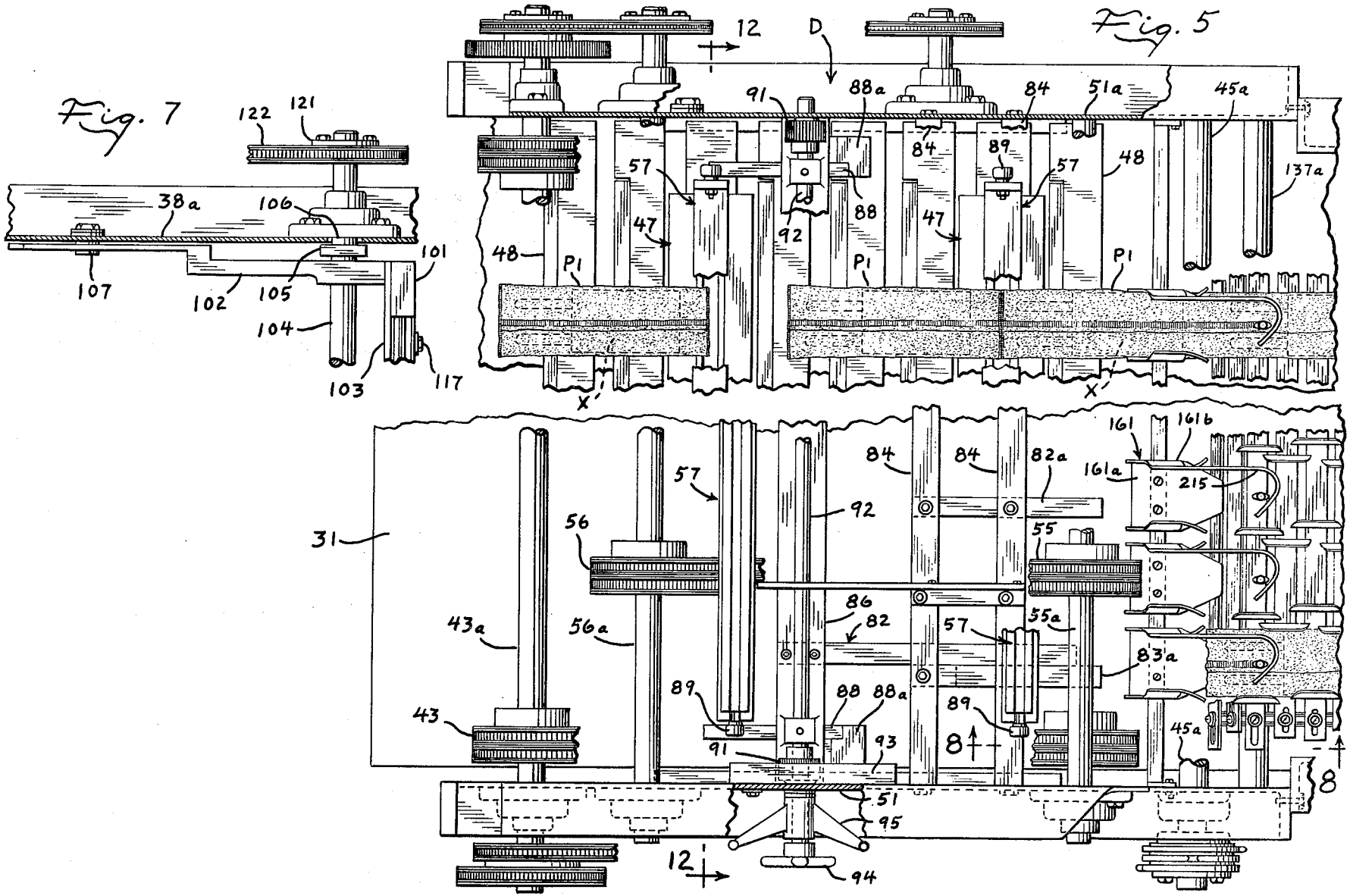
Figure 5A:
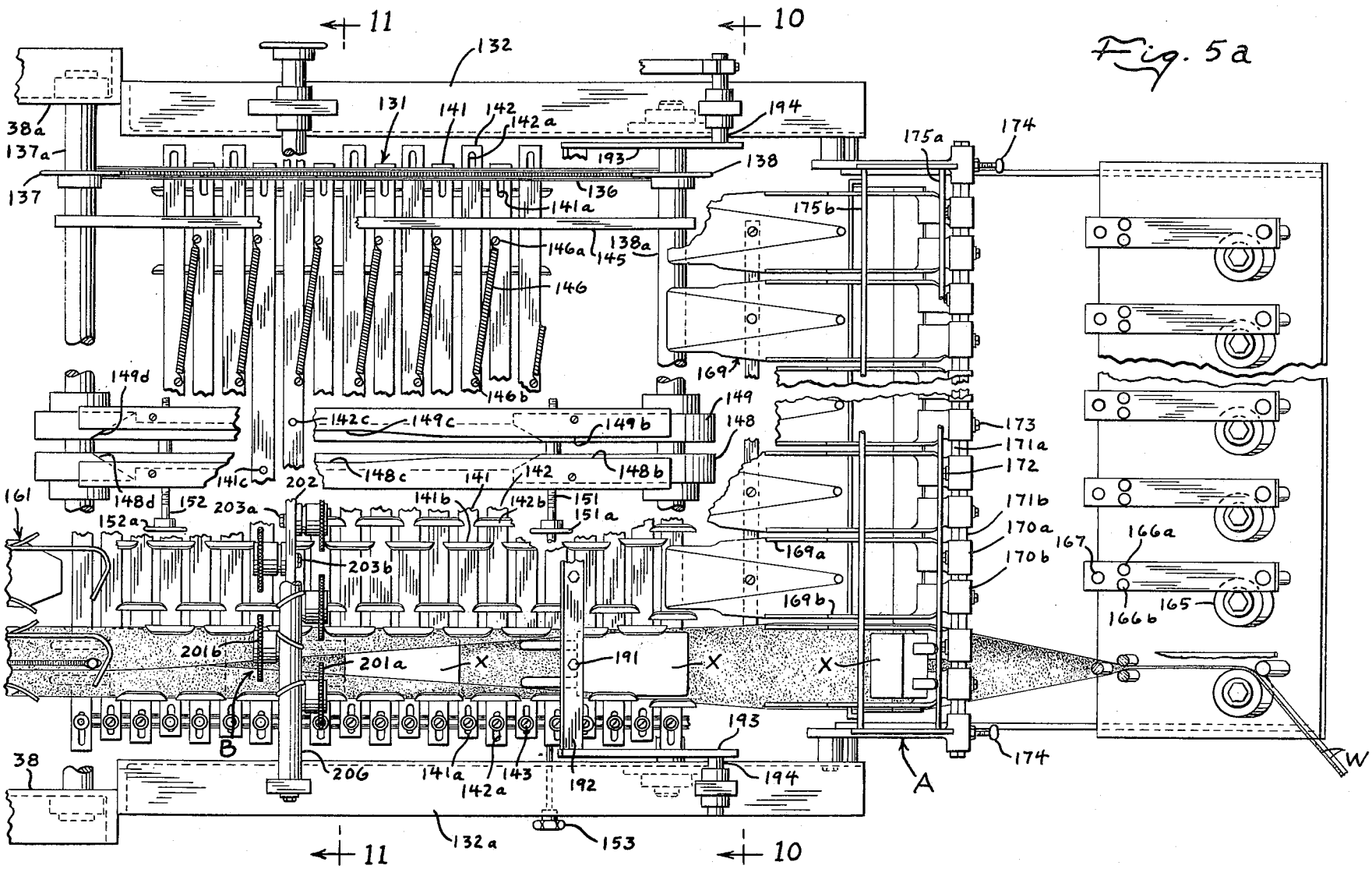
Figures 6, 8, 9:
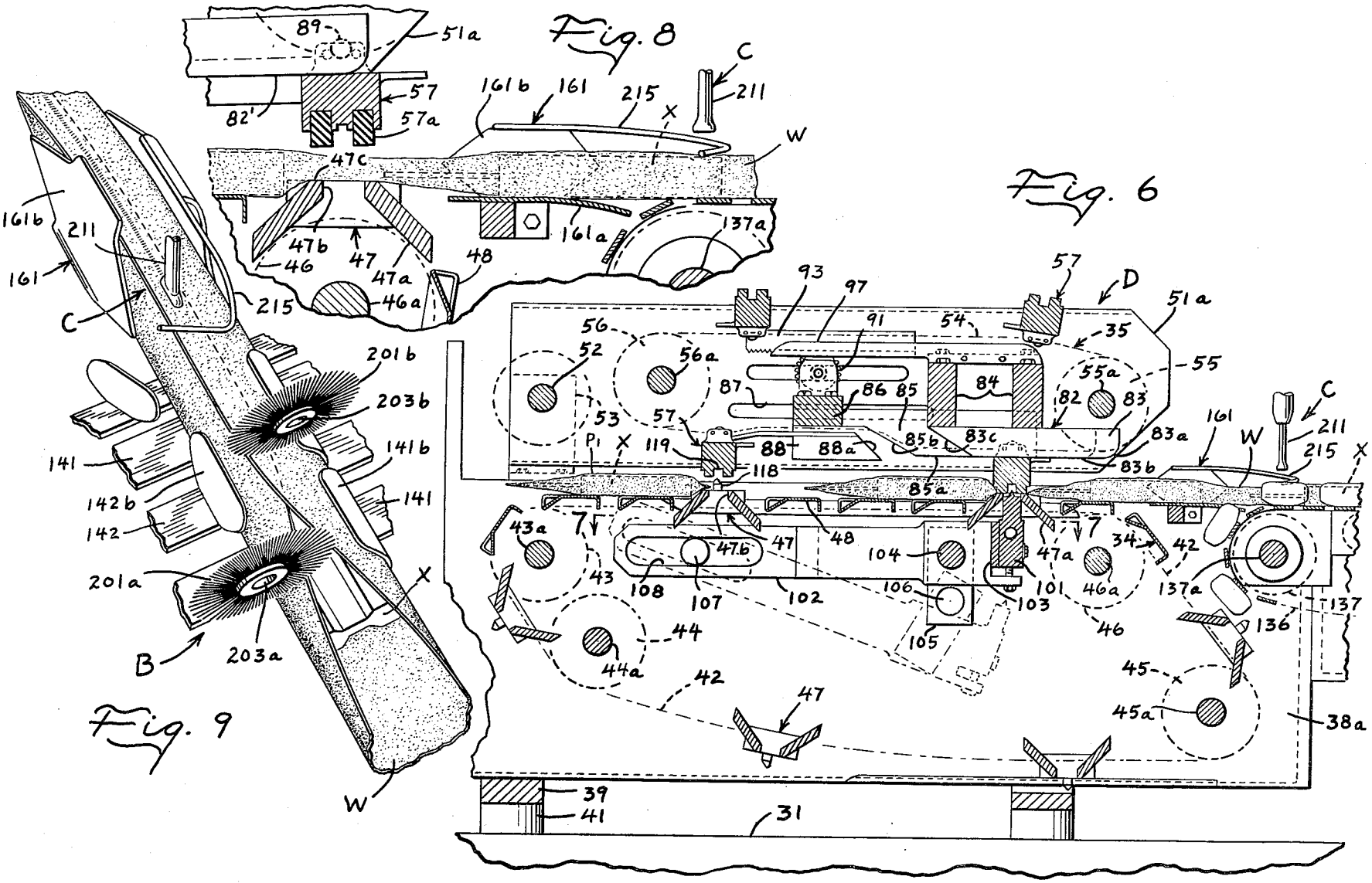
Figures 6A, 6B:
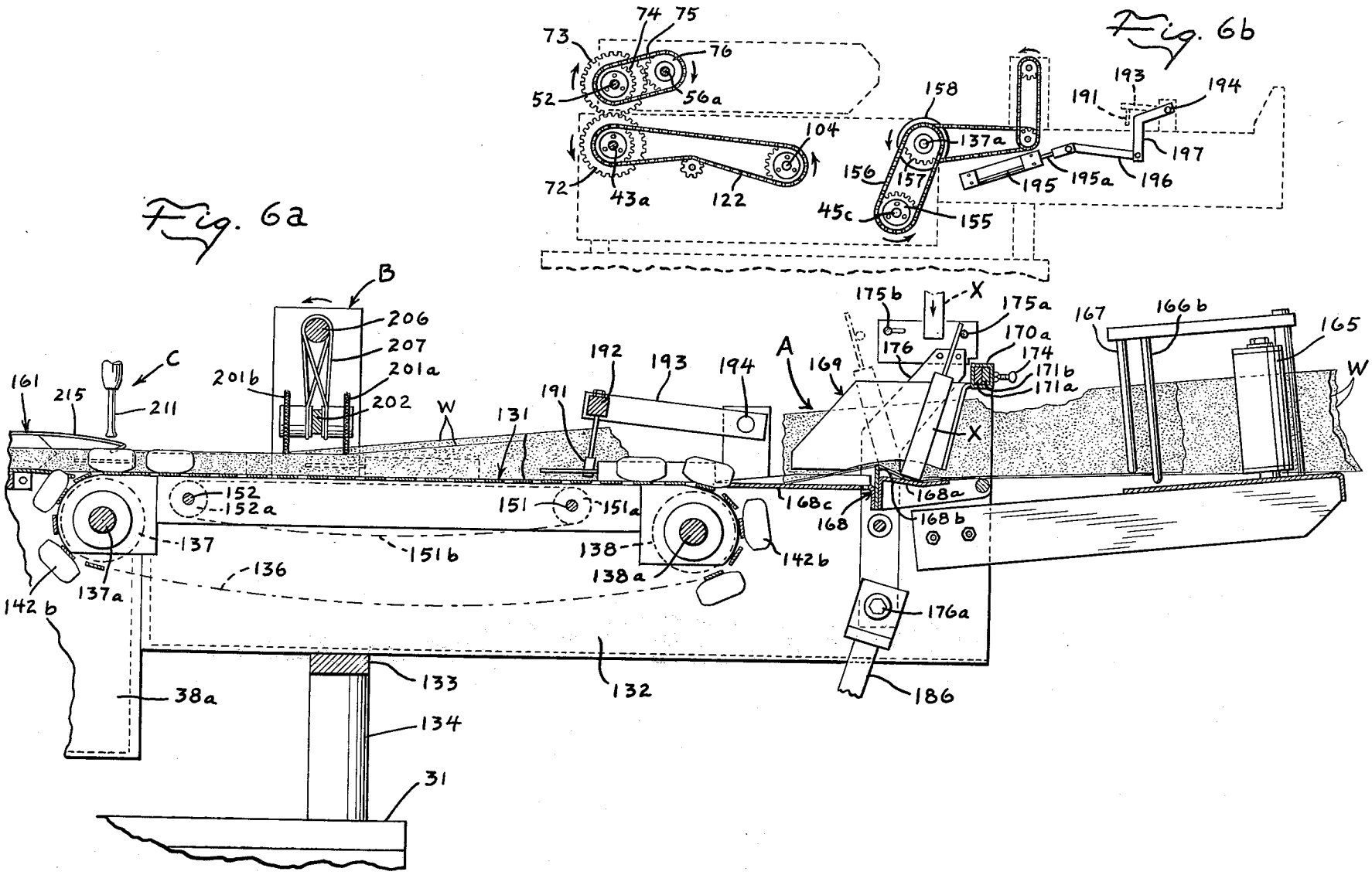
Figure 10:
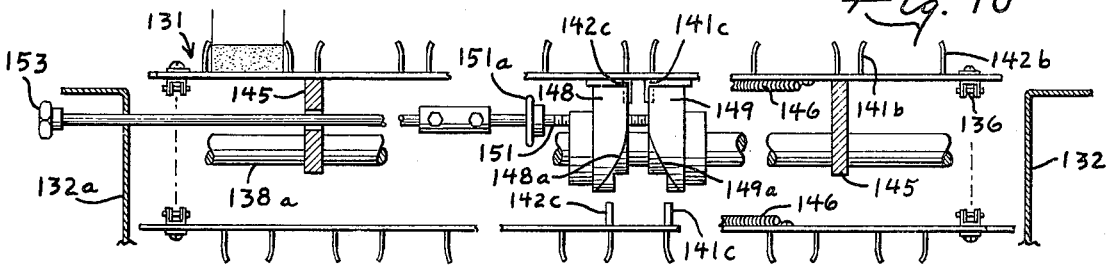

FIGS. 5 and **5*a* are top views of the outlet and inlet portions respectively of the wrapping machine, with parts broken away and shown in section to illustrate details of construction FIGS. 6 and 6*a*** are longitudinal vertical sectional views through the outlet and inlet portions respectively of the wrapping machine;

FIG. **6*b* is a diagrammatic view illustrating parts of the conveyor drive mechanism located at the side of the machine opposite that shown in FIG. 1**;

FIG. 7 is a fragmentary horizontal sectional view taken on the plane 7—7 of FIG. 6 and illustrating the mounting for the sealing and cutting jaw;

FIG. 8 is a fragmentary sectional view taken on the plane 8—8 of FIG. 5;

FIG. 9 is a fragmentary perspective view illustrating the longitudinal folding and sealing apparatus;

FIG. 10 is a fragmentary transverse sectional view taken on the plane 10—10 of FIG. 5*a;*

Figure 11:
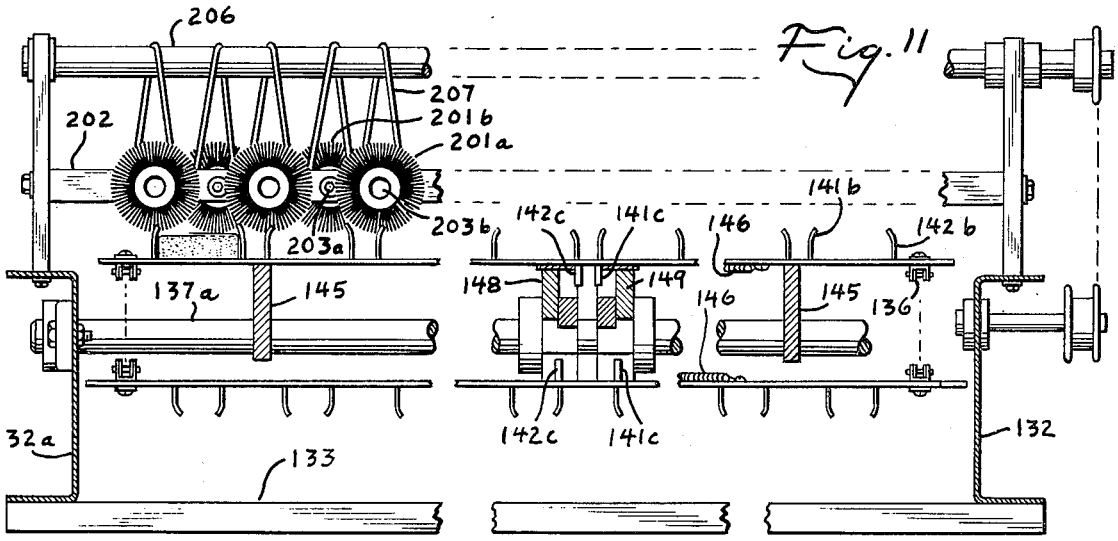

FIG. 11 is a fragmentary transverse sectional view taken on the plane 11—11 of FIG. 5*a;*

Figure 12:
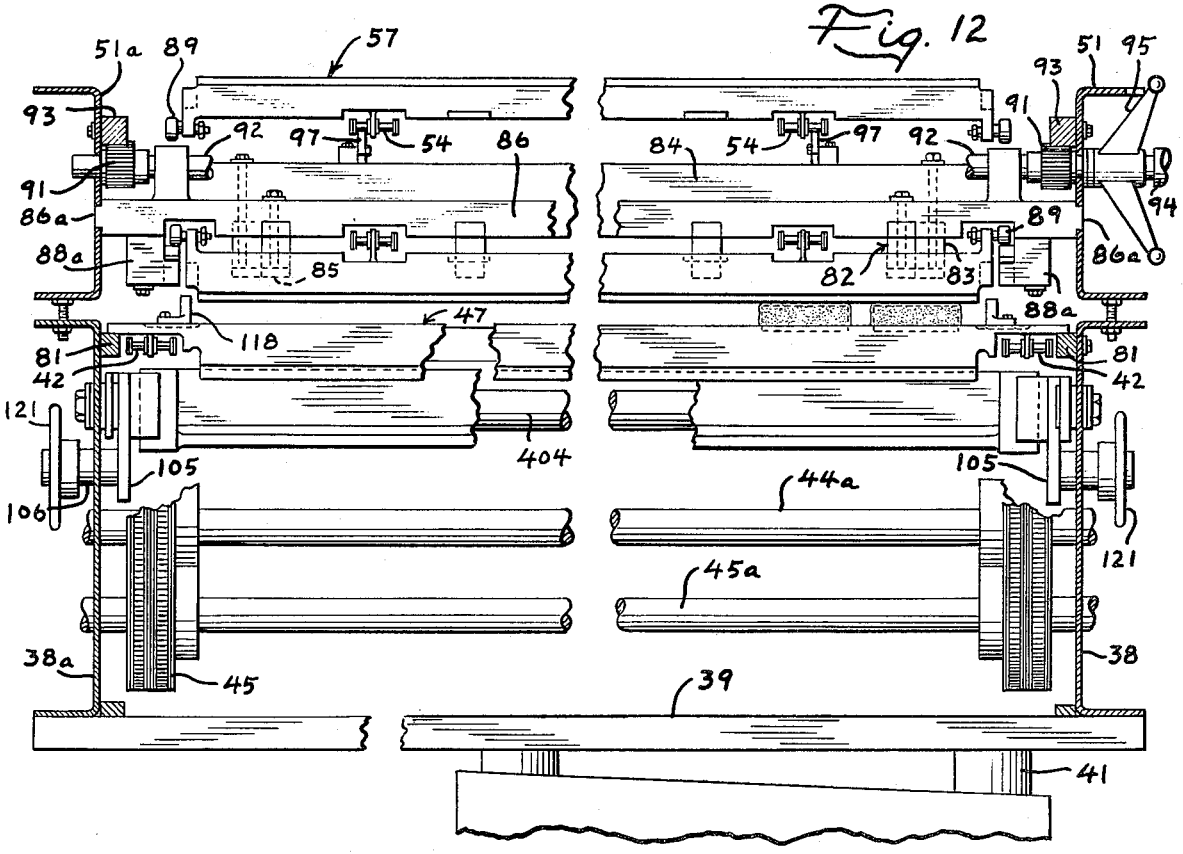
Figure 19:
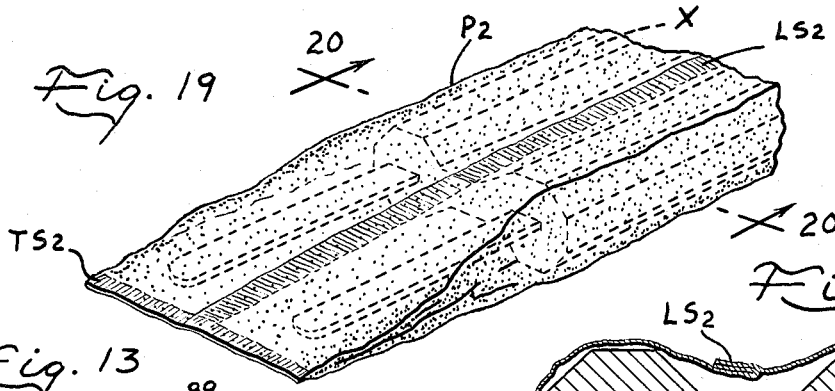
Figure 20:
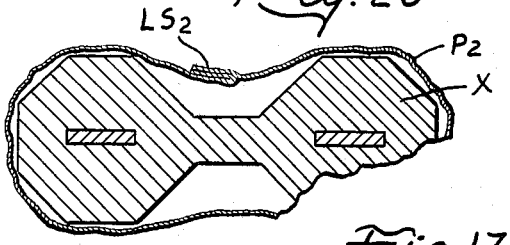
Figure 13:
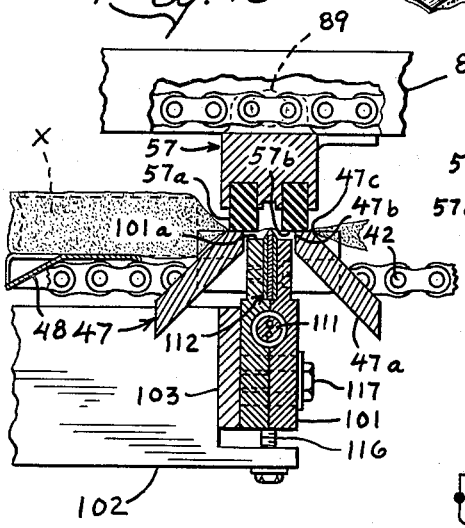
Figure 16:
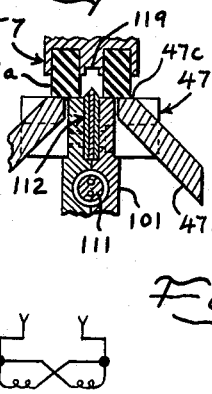
Figure 18:
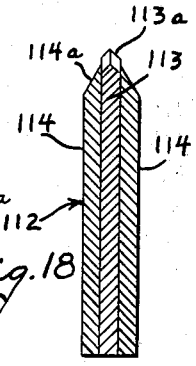
Figure 17:
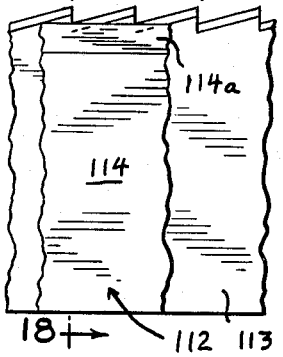
Figure 24:
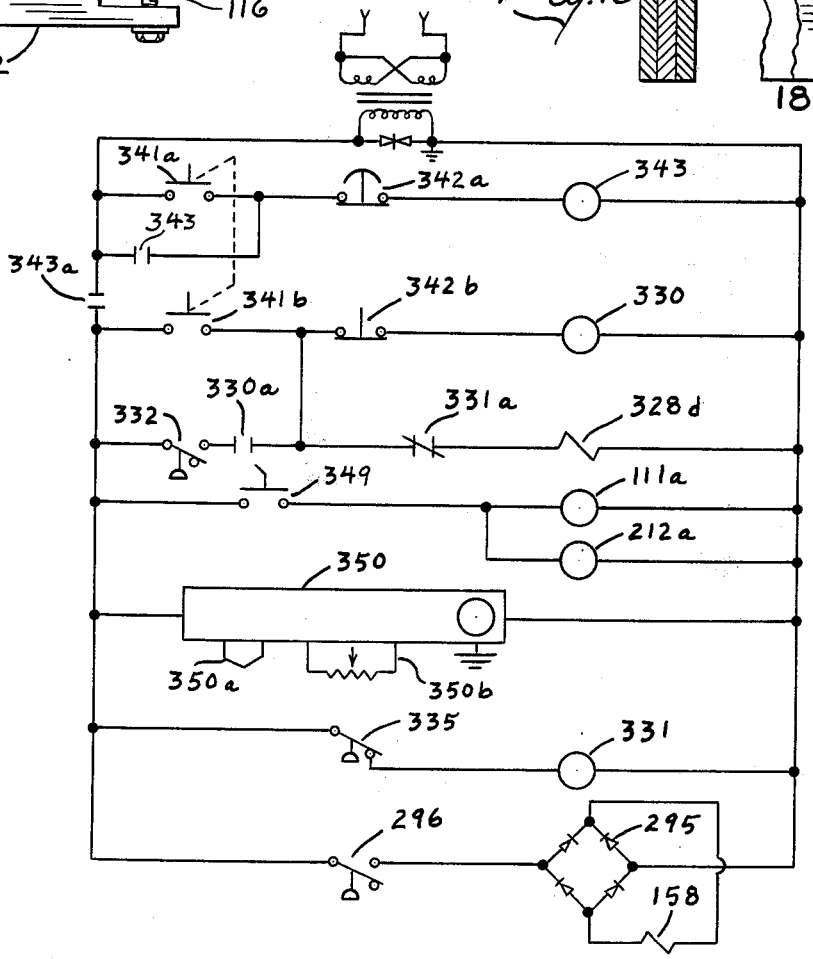
Figure 14:
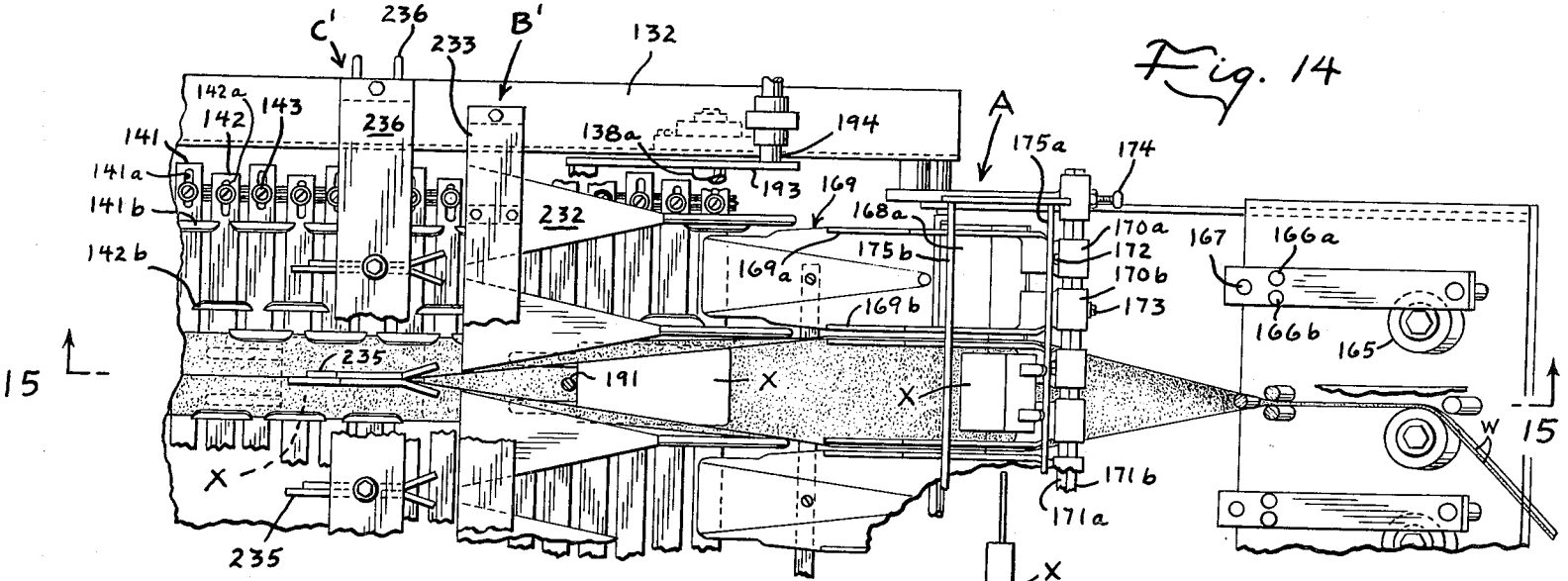
Figure 15:
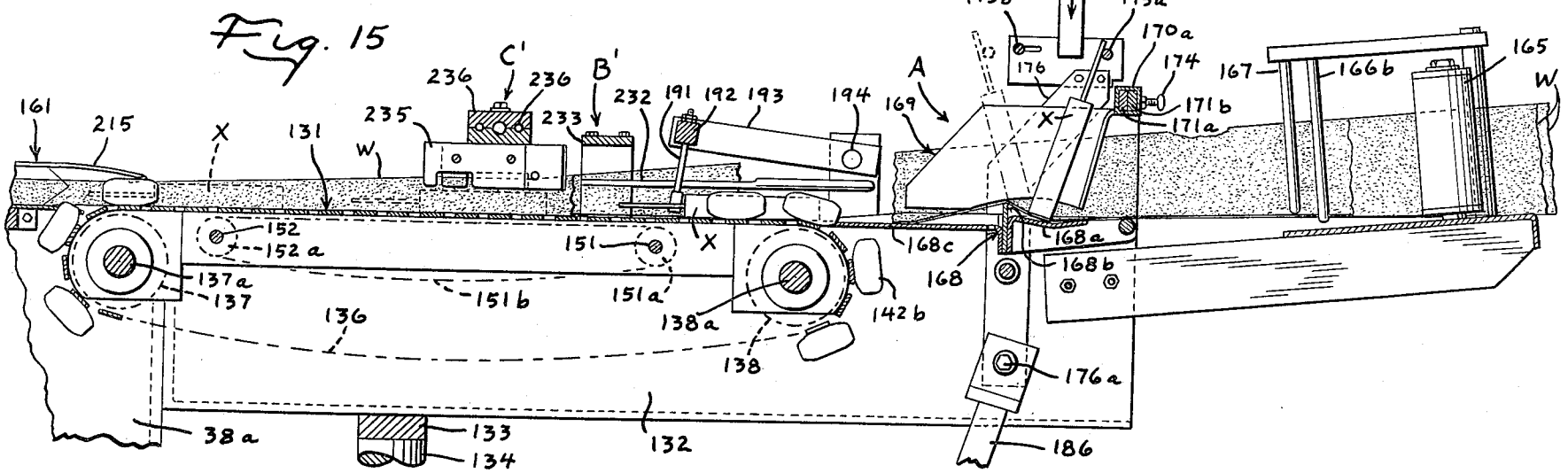
Figure 21:
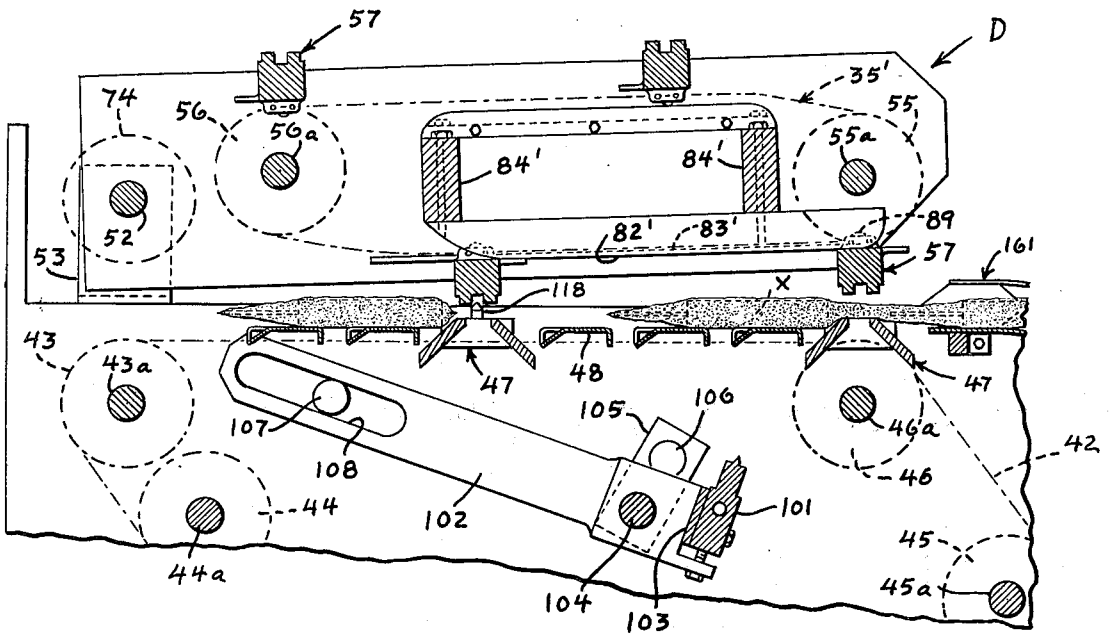
Figure 22:
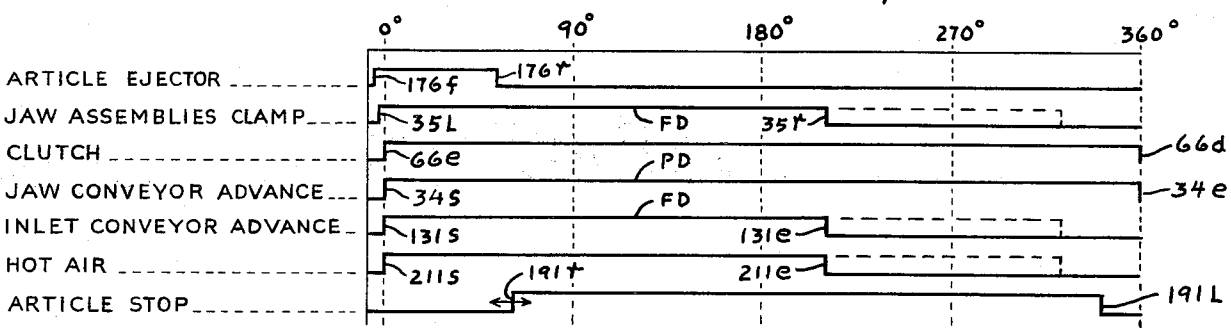
Figure 23:
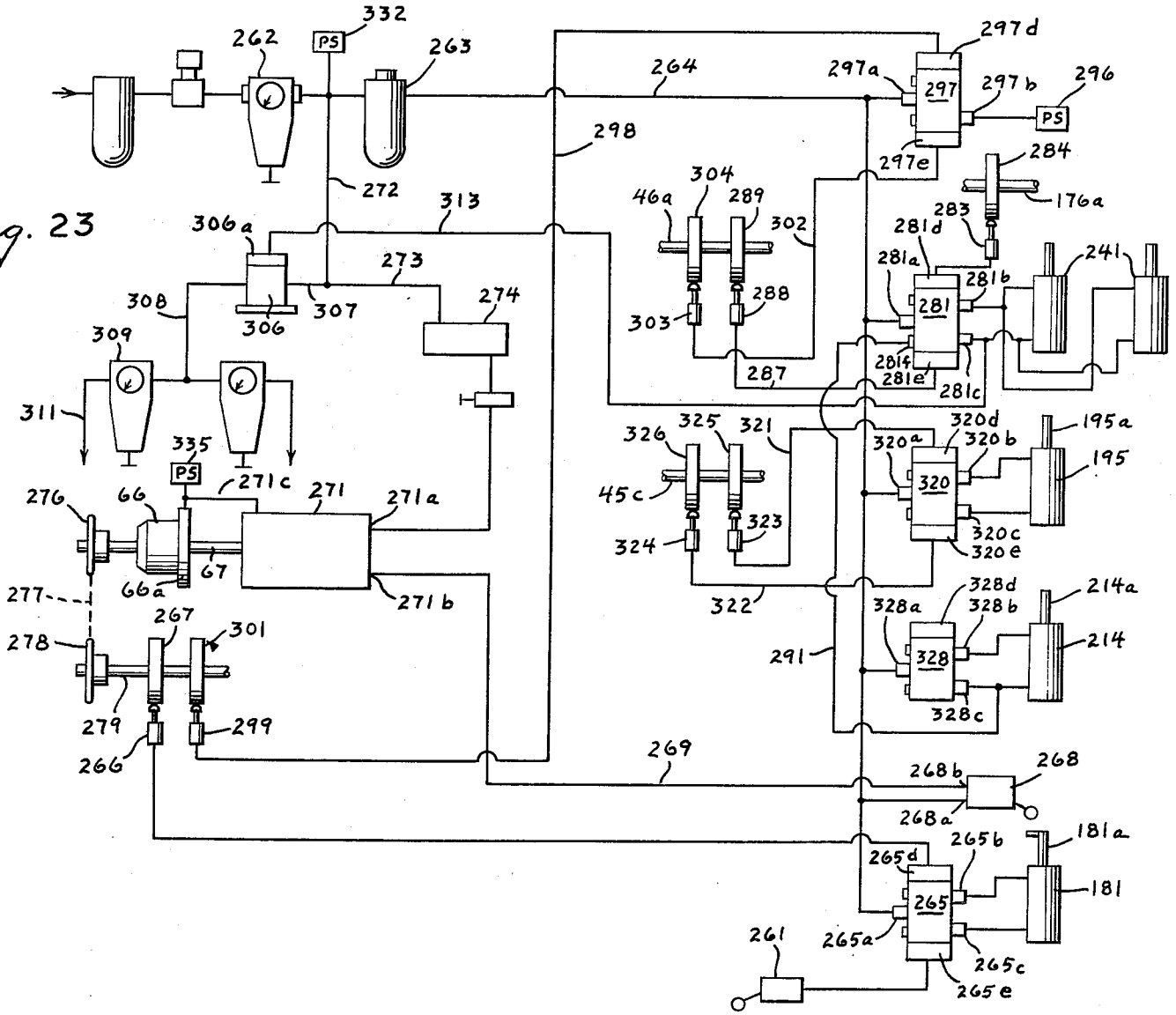

FIG. 12 is a fragmentary transverse sectional view taken on the plane 12—12 of FIG. 5;

FIG. 13 is a fragmentary transverse sectional view through the clamping and heat sealing jaws adapted for use with heat sealable plastic film wrapping material;

FIG. 14 is a fragmentary top view of the inlet portion of the wrapping machine modified to wrap articles in strips of coated paper or foil;

FIG. 15 is a fragmentary longitudinal sectional view taken on the plane 15—15 of FIG. 14;

FIG. 16 is a fragmentary transverse sectional view through the sealing and clamping jaws adapted for use with coated paper type wrapping material;

FIG. 17 is a fragmentary side view of the sealing and cutting member on a larger scale than FIG. 16;

FIG. 18 is a transverse sectional view taken on the plane 18—18 of FIG. 17;

FIG. 19 is a fragmentary perspective view of a package formed of coated paper or foil;

FIG. 20 is a transverse sectional view through the package taken on the plane 20—20 of FIG. 19;

FIG. 21 is a fragmentary longitudinal sectional view illustrating a modified form of upper jaw conveyor;

FIG. 22 is a graph illustrating timing of the wrapping machine;

FIG. 23 is a schematic diagram of the pneumatic control circuits for the wrapping machine; and FIG. 24 is a schematic electrical diagram of the electrical control circuits for the wrapping machine.

The article wrapping machine in the present invention is generally adapted for use in wrapping articles in an elongated strips of wrapping material and for sealing and severing the strips between adjacent articles to form separate packages. However, frozen confection bars and frozen stick confections present particular problems while wrapping the same in a heat sealable wrapper. Frozen confections tend to melt slightly at their surface and become very slippery when the wrapper is heated as occurs during the heat sealing operations and it is difficult to maintain the frozen confections in proper position in the wrapper, as the wrapper is advanced past the successive stations. The wrapping machine is particularly adapted for wrapping such frozen confections and is herein illustrated and described in connection with such use, it being understood that the wrapping machine can be used for wrapping articles other than frozen confections. The wrapping machine is advantageously of the multi-lane type for simultaneously receiving and wrapping a plurality of articles corresponding to a number of lanes in the wrapping machine. In general, the machine includes article depositing mechanism A for depositing articles on the strips; longitudinal strip folding mechanism B for folding the strips into tubes around the articles; longitudinal seaming mechanism C for sealing the edges of the enfolded tubes, and transverse sealing and feed mechanism D that includes upper and lower jaw assemblies operative to grip the enfolded tubes therebetween to advance the strips of wrapping material through the machine and to transversely sever and seal the enfolded tubes.

Referring now more specifically to the accompanying drawings, the machine is mounted on a base including a top 31 supported on legs 32 and having a shelf 33 spaced below the top for supporting some of the drive mechanism. The transverse sealing and feed mechanism D includes a lower endless type jaw conveyor 34 and an upper endless type jaw conveyor 35 that overlies the upper run of the lower jaw conveyor. The lower jaw conveyor 34 is mounted on a frame including spaced side members 38, 38*a* that are supported by cross rails 39 and legs 41 (FIG. 6) on the top 31 of the base. The lower jaw conveyor comprises a pair of endless chains 42 that are entrained over sprockets 43, 44, 45, and 46. Sprockets 43–46 are secured to respective shafts 43*a* – 46*a* and the shafts are journaled in the side members 38, 38*a* at locations such that the chain 42 defines a generally horizontal upper run as it extends from the sprocket 46 to the sprocket 43, and sprockets 44 and 45 are idler sprockets that guide the return run of the chain so that the return run is spaced a substantial distance below the generally horizontally upper run. A plurality of lower jaw assemblies 47 are mounted on the chains 42 to extend crosswise of the lower conveyor and are pitched along the chains a distance substantially greater than the maximum length of the packages to be formed. Article support bars are also mounted on the lower chains 42 at locations intermediate the lower jaw assemblies 47 to underlie and support the wrapper and articles. The upper endless conveyor 35 is mounted on a frame including spaced side members 51, 51*a*. The upper frame is advantageously mounted for movement between a lower or operative position shown in solid lines in FIG. 1 and raised or inoperative position shown in phantom in FIG. 1. For this purpose, side members 51, 51*a* are pivotally supported adjacent the discharge end of the upper conveyor on a shaft 52 that is rotatably supported in brackets 53 attached to the frame of the lower jaw conveyor. The upper frame is thus supported for pivotal movement about the axis of the shaft 52 between its lower and raised positions. The upper jaw conveyor 35 includes laterally spaced endless chains 54 entrained over sprockets 55 and 56. Sprockets 55 and 56 are secured to shafts 55*a* and 56*a*, respectively, which shafts are rotatably mounted on the side members 51, 51*a* at locations such that the lower run of the upper chain extends generally lengthwise of at least a portion of the upper run of the lower conveyor. Upper jaw assemblies 57 are mounted on the chains 54 at locations spaced therealong a pitch distance equal to the pitch distance of the lower jaw assemblies on the lower conveyor.

The upper and lower jaw conveyors are cyclically driven in timed relation with each other so that the jaw assemblies of the upper and lower conveyors move in opposed pairs as they advance along the adjacent runs of the upper and lower jaw conveyors. This drive mechanism is best shown in FIG. 1 and 4 and includes a drive motor 61 that operates through a speed reducer 62 to continuously drive a sprocket 63 when the motor is energized. The drive sprocket 63 is connected through a chain 64 to a sprocket 65 on a one revolution clutch 66. The one revolution clutch has output shaft 67 which is driven through one revolution each time the clutch is energized and the output shaft is connected through a sprocket 68 and chain 69 to a sprocket 70 on the shaft 43*a* of the lower jaw conveyor. The sprockets 68 and 70 are sized so as to advance the lower jaw conveyor a distance equal to the pitch distance of the lower jaw assemblies, each time the shaft 67 is rotated through one revolution. The upper jaw conveyor is driven at the same speed as the lower jaw conveyor and, as best shown in FIG. 6*b*, a gear 72 on the lower jaw conveyor shaft 43*a* meshes with a gear 73 on the shaft 52 and shaft 52 is, in turn, connected through a sprocket 74, and chain 75 to a sprocket 76 on the upper jaw conveyor shaft 56*a*. The gears 72, 73 and sprockets 74, 76 operate to drive the upper conveyor on a one-to-one relation with the lower conveyor so that the upper jaw conveyor is also advanced a distance equal to the pitch distance of the upper jaw assemblies, each time the clutch shaft 67 rotates through one revolution.

Jaw operating mechanism is provided for pressing the opposed pairs of upper and lower jaw assemblies into clamping engagement with the enfolded tube of wrapping material at locations intermediate the articles during a selectively adjustable portion of each drive cycle, as the jaws advance along the adjacent runs of the upper and lower conveyors a preset distance substantially less than the pitch distance, to clamp the enfolded tube of wrapping material therebetween and advance the tube therewith a distance corresponding to the preset distance, and to thereafter release the opposed pair of upper and lower clamping jaw assemblies from clamping engagement with the tube to interrupt the advance of the tube. In this manner, the distance through which the tube is advanced and hence the length of the packages formed by the machine can be selectively adjusted. The lower jaw assemblies 47 are supported during movement along the generally horizontally upper run of the lower conveyor on guide rails 81 (See FIG. 12) so that the lower jaw assemblies are maintained at a fixed elevation or level during advance along the lower run. The upper jaw assemblies 57 are guided during movement along their lower run by upper guide rails 82. In the form shown in FIGS. 1–20, the upper jaw guide rails 82 are made adjustable so as to adjust their effective length and hence adjust the distance through which they hold the upper jaw assemblies in engagement with the lower jaw assemblies as they move along the adjacent runs thereof. As best shown in FIGS. 5, 6, and 12, the upper guide rails 82 include stationary guide members 83 that are attached to cross members 84. The cross members 84 extend behind and are secured to the side members 51, 51*a* of the upper frame and support the guide rail sections 83 at a fixed location adjacent the inlet end of the upper jaw conveyor. The guide rail sections 83 define a guide surface having an inlet end 83*a* (FIG. 6) adjacent the inlet end of the conveyor, a lower guide surface 83*b* adapted to engage and press the upper jaw assemblies 57 against the lower jaw assemblies, and a trailing end 83*c*. The upper guide rails 82 also include adjustable rail sections 85 that are mounted on adjustable cross member 86. The adjustable cross member 86 has end portions 86*a* (FIG. 12) that extend into slots 87 in the side members 51 and 51*a*. The guide rail sections 85 extend alongside the guide rail sections 83 and have a lower guide surface 85*a* that forms a continuation of the guide surface 83*b* on the rail sections 83, and a trailing end 85*b*. Adjustment of the rail sections 85 relative to the rail sections 83 thus adjusts the effective length of the upper guide rails 82, to control the portion of each cycle during which the upper jaws are pressed or clamped against the lower jaw assemblies. The upper jaw assemblies, when clamped against lower jaw assemblies, operate to clamp the enfolded tube therebetween and to advance the tube and hence the strip of wrapping material a distance correlative with the distance through which they travel when clamped together. In order to assure positive separation of the upper jaw assemblies from clamping engagement with the tube, after they have traveled their preset distance, auxilliary cams 88 are provided on the cross member 86 with a ramp portion 88*a* arranged to engage roller 89 (see FIG. 12) on the ends of the upper jaw assemblies to positively raise and separate the upper jaw assemblies from clamping engagement with the tubes. As best shown in FIGS. 6 and 12, adjustment of the cross member 86 is effected by pinions 91 attached to a cross shaft 92 on the cross member 86 and which pinions mesh with racks 93 mounted on side members 51 and 51*a*. Cross shaft 92 can be selectively rotated as by a knob 94 (FIGS. 1 and 5) to adjust the rail sections 85 and cams 88 in a direction lengthwise of the path of travel, and means such as a wing nut 95 is provided on the shaft 92 for selectively locking the shaft in an adjusted position along the side frame members. Return guide rails 97 are mounted on the cross members 84 to underlie and support the upper jaw conveyor chains 54 and the upper jaws during the return run thereof.

The enfolded tubes of wrapping material are severed and sealed along opposite sides of the line of severance while the tubes are clamped between the upper and lower jaw assemblies. As best shown in FIG. 6, each lower jaw assembly 47 includes a pair of laterally spaced jaw members 47*a* that are spaced apart in a direction lengthwise of the article path to define a jaw opening 47*b* therebetween, and a heat sealing and cutting member 101 extends crosswise of the lower jaw conveyor and is mounted for movement in a closed loop course in time relation with the lower jaw conveyor, into and out of the lower jaw opening. For this purpose, a pair of arms 102 (FIGS. 6 and 7) are provided adjacent opposite sides of the lower conveyor and interconnected by a crosspiece 103. The arms 102 are mounted on a cross shaft 104 that extends between rank arms 105 and the crank arms that are rotatably supported by stub shafts 106 on the side members 38, 38*a*. The sealing and cutting member 101 is mounted on the crosspiece 103 for movement therewith and the cranks are rotated in unison to move the jaw members in a closed loop course sequentially into the jaw opening 47*b* in the lower jaw assembly while the upper and lower jaw assemblies are pressed into clamping engagement with the tube, and then out of the opening in the lower jaw assembly before the upper and lower jaw assemblies are released. In order to maintain the sealing and cutting member in a generally upright position while in the opening 47*b* in the lower jaw assembly, the ends of the arms 102 remote from the jaw assembly are guided as by guide pins 107 that are slidably received in slots 108 in the arms.

The wrapping machine is adapted to be utilized with different types of wrapping material including heat sealable thermoplastic film and coated wrapping material such as foil or paper having a heat sealable coating on at least one side. The upper and lower jaw assemblies and the heat sealing and cutting members are shown on an enlarged scale in FIGS. 13 and 16–18. The spaced jaw members 47*a* of each lower jaw assembly 47 define a jaw opening 47*b* therebetween and a pair of flat sealing faces 47*c* on opposite sides of the jaw opening. Each upper jaw assembly 57 has a pair of spaced preferably resilient jaw elements 57*a* mounted thereon and which define a pair of flat sealing faces 57*b* at the underside. As shown in FIG. 13, the sealing faces 57*b* on the upper jaw assemblies partially overlap the sealing faces 47*c* on the lower jaw assemblies to clamp the wrapper therebetween. The heat sealing and cutting member 101 is arranged to move into the lower jaw opening 47*b* to sever the wrapper in a region intermediate the faces 47*c* on the lower jaw member, and to seal the wrapper on opposite sides of the line of severance. The heat sealing and cutting member 101 has a heating element 111 mounted therein to heat the same and a cutting blade assembly 112 mounted in a recess 101*b*. The cutting blade assembly 112 is adapted for use with either thermoplastic film or coated paper or foil wrappers and includes a central blade member 113 having an upper serrated edge 113*a* and a pair of side blade members 114 at opposite sides of the central blade member and which have a beveled upper edge 114*a* that extends downwardly and outwardly from adjacent the lower edge of the serrations 113*a* in the central blade. The serrated edge 113*a* of the central blade is provided for cutting wrapping materials of the type that are not heat fusable, for example paper or foil wrapping material, and it has been found advantageous to arrange the serrations so that one edge of each notch extends generally perpendicular to the axis of the blade while the other edge is inclined at an angle thereto. The central blade is preferably sharpened as best shown in FIG. 17 in a direction crosswise of the blade. The beveled edges 114*a* on the side blades 114 are provided for severing and heat sealing thermoplastic film type wrapping materials. The composite blade is firmly clamped between opposed half sections of the jaw element 101 so as to be heated therewith by the heating element 111. The heat sealing and cutting member 101 is mounted for limited adjustment relative to the arms 102 as by screws 116 and is adapted to be locked in adjusted position as by screws 117. When heat sealing and cutting thermoplastic films to form packages such as P1 in FIG. 2; the heat sealing and cutting member is adjusted relative to the arms 102 so that the upper faces 101*a* on the heat sealing and cutting member are spaced below the upper surface of the sealing faces 47*c* on the lower jaw assembly, when the sealing and cutting member is moved into the jaw opening 47*b*, as shown in FIG. 13. The composite blade 112, however extends upwardly above level of the jaw faces 47*c* a distance sufficient to contact the film to sever the enfolded wrapper and to meet the plastic and form a bead-type transverse heat seal TSl at opposite sides of the line of severance. When sealing coated type wrapping material such as paper or foil having a thermoplastic coating on the inner sides thereof the blade is adjusted upwardly relative to the arms 102 to a level such that the sealing faces 101*a* and the heat sealing and cutting member contact the sealing faces 57*b* on the upper jaw assembly to transversely heat seal the coated wrapping material therebetween. This forms packages such as shown at P2 in FIG. 19 having a flat transverse seal TS2 at each end of the package. The serrated cutting blade 113 projects above the level of the sealing faces 47*c* and operates to sever the strip of wrapping material intermediate the sealing faces. In order to assure that the upper and lower jaw assemblies move in unison when clamped together, lugs 118 (FIG. 6) are provided on the ends of the lower jaw assemblies and arranged to extend into recesses 119 in the respective upper jaw assembly 57. The heat sealing and cutting member 101 is driven in its orbital path in timed relation with the movement of the lower conveyor as sprockets 121 on the stub shafts 104, which sprockets are connected through chains 122 to sprockets 123 on the lower conveyor shaft 43*a* (FIG. 1 and 6*b*).

The strips of wrapping material W and the articles X therein are supported on an inlet conveyor 131 that has its inlet end adjacent the article depositing apparatus A and its outlet end adjacent the inlet end of the lower conveyor 34. The inlet conveyor is mounted on a frame that includes spaced side members 132, 132*a* that are attached to the side plates 38, 38*a* of the outlet conveyor and which are otherwise supported by a cross member 133 and posts 134 on the base. The inlet conveyor includes a pair of laterally spaced endless chains 136 entrained over sprockets 137 and 138. Sprockets 137 are mounted on a cross shaft 137*a* journaled in the side plates 38, 38*a*, and sprockets 138 are secured to a cross shaft 138*a* journaled in the side plates 132, 132*a*. The inlet conveyor is adapted to underlie and support the wrapper and the articles therein and is also arranged to grip the wrapper at relatively opposite sides of the articles to hold the articles in position in the wrapper as the wrapper is advanced therealong. The conveyor is formed by a first and second set of slats designated 141 and 142 arranged to extend crosswise of the chains in alternate succession therealong. Each of the slats is mounted for limited movement in a direction crosswise of the inlet conveyor and, as shown, the slats 141 and 142 have slots 141*a* and 142*a* respectively at opposite ends thereof and fasteners 143 extend through the slots to attach the slats to the chains. The slats of the inlet conveyor are supported during movement along the upper run on rails 145 that underlie the slats. The slats 141 of the first set each have a plurality of clamp members 141*b* corresponding in number to the number of lanes on the wrapping machine, which clamp members are secured to the slats as by welding at spaced locations therealong and extend transverse to the slats to engage the wrapper at one side of the articles therein. The slats 142 of the other set similarly have a plurality of clamp members 142*b* thereon, corresponding in number to the number of lanes of the wrapping machine, and which clamp members extend transverse to the slats 142 at spaced locations therealong to engage the wrapper at the other side of the articles therein. As best shown in FIG. 5*a*, the clamp members 141*b* and 142*b* are preferably elongated in a direction paralleling the direction of advance of the inlet conveyor so that the clamp members engage and apply pressure generally uniformily along the length of the wrapper. The slats 141 and 142 are yieldably biased in relatively directions as by tension springs 146 (FIG. 5*a*) that are terminally attached by fasteners 146*a* and 146*b* to adjacent ones of the slats, as best shown in FIG. 5. The springs 146 are arranged to bias the slats 141 and 142 in directions to yieldably press the clamp members 141*b* and 142*b* against relatively opposite sides of the wrapper to yieldably clamp the article therein. A cam mechanism is provided for positively shifting the slats 141 and 142 in directions to separate the clamp members 141*b* and 142*b* from the wrapper.

As best shown in FIGS. 5*a*, 10 and 11, the slats 141 and 142 respectively have follower pins 141*c* and 142*c* extending transversely thereof at the side opposite the clamp members 141*b* and 142*b*. Cam tracks 148 and 149 are disposed below the upper run of the inlet conveyor and arranged to engage the cam followers 141*c* and 142*c* respectively. As shown in FIG. 10, the cam tracks 148 and 149 have relatively converging portions 148*a* and 149*a* adjacent the inlet end of the conveyor for engaging the followers 141*c* and 142*c* to move the slats 141 and 142 to a release or separated position. The converging track portions 148*a* and 149*a* merge with relatively parallel dwell portions 148*b* and 149*b* (FIG. 5*a*) that maintain the clamp members on the slats 141 and 142 in a release position as the slats travel along the initial portion of the inlet run. The cam tracks also include portions 148*c*, 149*c* which are spaced relatively farther apart than the portions 148*b* and 149*b* to release the cam followers and allow the springs 146 to urge the slats 141 and 142 into clamping engagement with the wrappers. Adjacent the outlet end of the conveyor, the cam tracks have relatively converging portions 148*d*, 149*d* to again engage the cam followers and move the clamp members to a release position as the slats 141 and 142 pass around the outlet sprocket. The cam tracks 148 and 149 are conveniently mounted on the cross shafts 137*a* and 138*a* for limited adjustment in a direction crosswise of the conveyor and a means such as oppositely threaded screws 151 and 152 (FIGS. 5*a* and 10) engage the cam tracks 148 and 149 to adjust the position of the cam tracks relative to each other and relative to the inlet conveyor and thereby adapts the inlet conveyor to articles of different widths. The screws 151 and 152 can be interconnected for simultaneous rotation as by sprockets 151*a* and 152*a* and a chain 151*b* (FIG. 6*a*) and the shafts can be rotated as by a knob 153 adjacent the side of the inlet conveyor. It will thus be seen that the inlet conveyor not only underlies and supports these strips of wrapping material and the articles therein, but also has clamp members thereon which are operated to a release position as they advance adjacent the inlet end of the conveyor to allow articles to be deposited in the wrapper, and which are thereafter moved to a clamping position under the bias of springs 146 to hold the articles in proper position in the wrapper as the inlet conveyor is advanced. The clamp members are thereafter moved to a release position adjacent the outlet end of the conveyor.

The upper and lower outlet conveyors 35 and 34 operate to grip the enfolded strip of wrapping material during a selectively presettable portion of each drive cycle to advance the strip of wrapping material a distance less than the pitch distance of the jaws on the upper and lower conveyors. Provision is made for driving the inlet conveyor at a speed correlative with the speed of the upper and lower conveyors during the adjustably presettable portion of the drive cycle to advance the upper run of the inlet conveyor a distance substantially equal to the preset distance the wrapping material is advanced by the upper and lower conveyors. As shown in FIG. 6*b*, one of the lower conveyor shafts 45*c* is connected through a sprocket 155 and a chain 156 to a sprocket 157 on the inlet conveyor shafts 137*a*. The sprocket 157 is mounted so that it is normally freely rotatable relative to the shaft 137*a* and is arranged to be drivingly connected to that shaft through a selectively operable clutch 158 which is operative, when actuated, to drive the shaft 137*a* with the sprocket 157. Any suitable type of clutch may be utilized and the clutch 158 may, for example, be an electroresponsive clutch which is selectively energized in a manner described more fully hereinafter to drive the inlet conveyor with the lower conveyor during that portion of each drive cycle that the upper and lower jaw assemblies are clamped against the wrapper to feed the same.

Transfer guides 161, best shown in FIGS. 5, 6, 8 and 9, are provided between the inlet conveyor 131 and the lower conveyors 34 and include a bottom plate 161*a* adapted to underlie and support the wrappers as they transfer from the inlet conveyor to the outlet conveyor, and side plates 161*b* arranged to engage opposite sides of the enfolded wrapper to laterally guide the same.

The lanes of the multi-lane wrapping machine are spaced on centers substantially narrower than the width of the strips of wrapping material. In order to feed the strips of wrapping material W to the several lanes, the strips are folded flat upon themselves and passed over guide rolls such as shown at 165 aligned with respective lanes of the machine. After the folded strip of wrapping material passes over its guide roll 165, it passes between spaced guide fingers 166*a* and 166*b* and a separator finger 167 extends downwardly between the sides of the folded wrapper to initiate spreading of the sides of the wrapper. An apparatus for feeding strips of wrapping material from a plurality of rolls, folding the strips into face-to-face contact and guiding the same to a multi-lane wrapping machine is disclosed in U.S. Pat. No. 2,918,769 issued Dec. 29, 1959, and reference is made to that patent for a more complete description of the apparatus for feeding, folding, and guiding the strips of wrapping material to the multi-lane wrapping machine.

The strips of wrapping material, after passing the separating fingers 167, pass over a support 168 and round an article chute 169 and onto the inlet end of the inlet conveyor 131. The article guide chute 169 is conveniently formed by separate side wall members 169*a* and 169*b* that are mounted for adjustment toward and away from each other to accomodate articles of different size. As best shown in FIGS. 5*a*, 6*a* and 14, the wall portions 169*a* and 169*b* of each article guide chute have generally rectangular hub portions 170*a* and 170*b* rigidly secured thereto and a pair of bars 171*a* and 171*b* extend through the hubs on the sidewise adjacent article chutes. The hub 170*a* on one wall portion 169*a* of each of the chutes is attached by fasteners 172 to one of the bars 171*a* and the hubs 170*b* on the other wall portions 169*b* are attached as by fasteners 173 to the other of the bars 171*b*. The bars 171*a* and 171*b* are, in turn, slidably adjustable relative to each other in a direction crosswise of the machine such as to enable simultaneous adjustment of the width of the several article chutes. Means such as fasteners 174 are provided for securing the bars in their adjusted position. The folded wrapper, after being separated by the guide pin 167, passes around the outer sides of the walls 169*a* and 169*b* of the respective chute so that the strips of wrapping material are formed into an upwardly opening channel at the article depositing station. The article support 168 includes a portion 168*a* that underlies the chute adjacent the inlet end of the chute to support the underside of the wrapper thereat and limit downward movement of the articles as best shown in FIGS. 6*a* and 15. The article support also includes a stop plate 168*b* arranged to engage the lower end of the article to prevent the same from sliding forwardly out of the chute, and a support guide 168*c* that extends from the plate 168*b* to the inlet end of the inlet conveyor.

The articles X, such as frozen stock confections, are fed to the article wrapping machine as diagrammatically shown in FIG. 1 by a machine M, and then dropped into the chutes at the article depositing station. The articles remain in an upwardly and rearwardly inclined position as best shown in FIGS. 6*a* and 15 until an article ejecting mechanism is actuated to tip the articles forwardly as shown in phantom in FIG. 6*a* until they drop onto the wrapper in a generally horizontal position with the sticks extending forwardly in the direction of advance of the wrapper W. The article ejector includes rods 175*a* and 175*b* that extend crosswise of the wrapping machine at the upper end of the article chutes, which rods are mounted on the upper ends of arms 176. The arms 176 are pivotally mounted on the side plates for movement about an axis 176*a* between a normal position as shown in solid lines in FIGS. 6*a* and 15 forwardly in the direction of advance of the wrapper to a discharge position shown in phantom. As best shown in FIG. 1, the article ejector mechanism is operated from a fluid cylinder 181 through a lever 182, shaft 183, lever 184 and link 185 connected to a lever 186 attached to the shaft 176*a*. The levers 182 and 184 are non-rotatably secured to the shaft 183 and the lever 186 is similarly non-rotatably secured to the shaft 176*a* to move the article ejector mechanism to a discharge position when the rod 181*a* and the cylinder 181 is extended.

Article stops 191 are provided for engaging the articles after they have been deposited in a horizontal position on the strips of wrapping material to position the articles at the proper location along the wrapping material. The article stops 191 comprise rods mounted on a cross bar 192 supported on arms 193 for movement between a lower or stop position and a raised position. The arms 193 are secured to stub shafts 194 and, as shown in FIG. 6*b*, the bar stops are operated by a fluid cylinder 195 having its rod 195*a* connected through a link 196 to a lever 197 non-rotatably secured to the shaft 194. The cylinder 195 is operative to move the bar stops to a raised position when the rod is retracted and to a lower or stop position when the rod is extended. Apparatus described more fully hereinafter is provided for operating the bar stops in timed relation with the advance of the wrapper to position the bar in the wrapper so that they will be in proper locations when they reach the transverse sealing and severing mechanism D.

As previously mentioned, the wrapping machine is adapted for use with wrapping material such as heat sealable thermoplastic film which can be heat sealed when overlapped to form an overlap type seal LS1. An improved folding apparatus for use with thermoplastic films and the like to form an overlap type seal, is illustrated in FIGS. 1, 5*a*, 6*a* and 9. The film folding mechanism includes a pair of rotary members 201*a* and 201*b* individual to each lane of the wrapping machine and mounted as on a cross bar 202 for rotation about axes 203*a* and 203*b* that extend generally parallel to and offset at relatively opposite sides of the center of the respective lane at locations such that the periphery of the rotary members engage the enfolded tube of wrapping material at the top of the articles therein. The rotary members are radially resilient and are conveniently in the form of brushes having generally radial bristles to resiliently contact the wrapping material, and each pair of rotary members are rotated in relative opposite directions and such as to urge the longitudinal edges of the enfolded tubes of wrapping material into overlapping relation. As shown in the drawings, the several rotary members are rotated from a common shaft 206 that extends crosswise of the rotary members at a level above the same. Individual belts 207 are utilized to connect each rotary member to the shaft 206, with the belts entrained in grooves on the respective rotary members and twisted to extend around the shaft 206 in such a manner as to rotate the members of each pair in relatively opposite directions.

When sealing heat sealable plastic film with an overlap type seal, a hot air type sealer is advantageously provided. The hot air sealer includes a plurality of nozzles 211, one individual to each lane of the wrapping machine, and arranged to direct a stream of hot air against the overlapping portions of the wrapping material to press the overlapping portions together and to longitudinally heat seal the same as shown at LS1 in FIG. 4. The several nozzles can be manifolded and the air supplied to the nozzles is heated by heaters 212, conveniently of the electrical type. In order to prevent overheating of the wrapping material during extended periods of nonuse, the nozzles and heaters are mounted for movement between a lower or operative position shown in solid lines in FIG. 1 and a raised or inoperative position shown in phantom. For this purpose, the heaters are supported on arms 213 and a fluid actuator 214 is provided for raising and lowering the arms and heaters. Film hold-on fingers 215 are advantageously provided to hold the film in an overlapping relation during the heat sealing of the same and, as best shown in FIG. 9, the fingers are conveniently mounted on the transfer guides 161. As described more fully hereinafter, provision is made for shutting off the flow of air to the nozzle 211 during the rather short dwell periods when the film is not being advanced by the transfer sealing and feed mechanism D, and provision is made for automatically raising the nozzles and heaters only during relative longer dwell periods.

When wrapping articles in paper or foil wrappers that have a heat sealable coating on only one side, and which require a fin type seal, somewhat different mechanism is utilized to fold the strips of wrapping into tubes and to longitudinally seal the same. As shown in FIGS. 14 and 15, the side portions of the U-shaped wrapper are passed between wrapper guide plows 232 which guide the upper edges of the wrapper into face-to-face contact. The inner and outer guide plows are supported above the respective lane of the wrapping machine on a cross bar 233 that extends crosswise between the side plates 132 and 132*a* of the inlet conveyor. Pairs of seaming shoes 235 are mounted on a heater bar 236 having a heater 236*a* therein, and the shoes are positioned along the bar to be heated thereby and form a slot therebetween for receiving the upper longitudinal edges of the strip of wrapping material. The shoes 235 are arranged to heat and press the longitudinal edges of the wrapper together and form a longitudinal fin type heat seal on the enfolded tube of wrapping material as shown at LS2 in FIG. 20.

As previously described, the main drive apparatus is operable to drive the upper and lower jaw conveyors through a drive cycle to advance the upper and lower jaw assemblies along the adjacent runs thereof a distance equal to the distance that the jaw assemblies are pitched along the respective jaw conveyor. However, the upper and lower jaw assemblies are pressed into clamping engagement with the tube during only a preset portion of each drive cycle as they advance along the adjacent runs of the upper and lower jaw conveyor means a preset distance substantially less than the pitch distance and this determines the distance through which the wrapping material is advanced and consequently the length of the packages formed by the machine. In the embodiment of FIGS. 1–20, the upper jaw guide rails 82 are adjustable to vary the effective length thereof and hence the distance through which the upper and lower jaw assemblies are held in clamping engagement. However, the portion of the drive cycle during which the upper and lower jaw assemblies are held in clamping engagement can also be controlled by relatively shifting the upper and lower jaw conveyors 35 and 34. The upper and lower jaw assemblies as they move around their respective inlet sprockets 55 and 46, travel in relatively converging paths toward the enfolded wrapper. In order to minimize scuffing of the upper and lower jaw assemblies due to nonalignment of the upper and lower jaw assemblies during such converging movement, and to achieve more precise control over the start of the advance of the wrapper by the jaws, the upper jaw conveyor 34 is preferably moved to a raised or inoperative position shown in phantom lines in FIG. 1 and in solid lines in FIG. 8, prior to the start of a drive cycle, and the drive cycle timed so that the upper and lower jaw assemblies are stopped at the end of a drive cycle in opposed relation, as shown in FIG. 8 At the initiation of a drive cycle, the upper jaw conveyor is first loweredto clamp the tube of wrapping material therebetween and the jaw conveyors then driven to thereafter advance the wrapper with the jaws. As best shown in FIG. 1, the upper jaw conveyor 35 is moved between a raised and lowered position by means of fluid cylinders 241 disposed at relatively opposite sides of the machine and each having its piston 241*a* connected through a bell crank 242 and link 243 to the respective side plate 51, 51*a* of the upper jaw conveyor. The bell cranks 242 are pivotally mounted at 244 on the side plate of the lower jaw conveyor. The fluid cylinders 241 are operative when retracted to raise the upper jaw conveyor and operative when extended to move the lower jaw conveyor to its lower position. In addition it will be seen that the force applied to the upper jaw conveyor to move it to its lower position and to hold it in its lower position is controlled by the fluid pressure in the cylinders 241 and, advantageously, provision is made for regulating this pressure to a preselected value to prevent damage to the machine in the event that obstruction is in position or moves into position between the opposed pairs of upper and lower clamping jaws. Operation of the upper jaw conveyor to its raised position is also controlled in timed relation with the drive cycle. In the apparatus as shown in the embodiment of FIGS. 1–2 using adjustable guide rails 82, operation of the fluid cylinder 241 to move the upper jaw conveyor to its raised position is timed so as to occur at or after the upper jaw assembly reaches the end of the guide rail section 85*a*. Alternatively, instead of utilizing longitudinally adjustable guide rails 82, fixed guide rails 82′ mounted on cross-members 84′ can be utilized as shown in FIG. 21. The fixed guide rails 82′ have a length greater than the length of the maximum size package to be formed on the machine and are arranged to press the upper jaw assemblies against a respective lower jaw assembly to clamp the enfolded wrapper therebetween, when the upper conveyor 35′ is lowered. Auxiliary rails 83′ are also mounted on the cross-members 84′ to underlie the rollers 89 on the upper jaw assemblies as they advance along lower run of the upper conveyor, to lift the upper jaw assemblies out of clamping engagement with the lower jaw assemblies, when the upper conveyor 35′ is raised. Operation of the fluid cylinder 241 is then controlled to lower the upper conveyor at the start of the drive cycle and then to raise the upper conveyor after the jaw assemblies advanced a preselected selectively adjustable distance less than the pitch distance of the jaws on the conveyors, to thereby move the upper and lower jaw assemblies out of clamping engagement with the tube and to interrupt the advance of the wrapper. The portion of the drive cycle during which the actuator 241 holds the upper jaw conveyor in its lowered position is made selectively adjustable in a manner described hereinafter to enable selective adjustment of the length of the packages formed by the machine.

Reference is now made more specifically to the pneumatic and electrical circuits shown in FIGS. 23 and 24 for controlling operation of the machine. The wrapping machine is advantageously arranged to cycle each time a group of articles are dropped into the article receiving chutes and, as diagrammatically shown in FIG. 1, a switch 261 is provided and arranged to be actuated each time a group of articles is dropped into the chutes. Switch 261 is arranged to actuate the article ejector cylinder 181 and, as shown in FIG. 23, fluid such as air is supplied through a pressure regulator 262 and lubricator 263 to a pressure line 264. Valve 265 is arranged to reversibly operate the cylinder 181 and has its 265*a* connected to the pressure line 264 and its control outlets 265*b* and 265*c* connected to relatively opposite ends of the cylinder. Valve 265 has pneumatic actuators 265*d* and 265*e* and trip valve 261 is connected to one of the actuators 265*e* to move the valve to a flow reversing position to extend the piston 181*a* of the pneumatic cylinder 181. Valve 265 will remain in its flow reversing position until the other actuator 265*d* is actuated under the control of valve 266 operated by a timer controlled cam 267.

The article ejector cylinder is operative, when extended, to move the article ejectors in a discharge position and discharge the articles from the chutes onto the strip of wrapping material. The article ejector cylinder is also arranged as shown in FIG. 23, to actuate a wrapper start switch 268. The switch 268 has its inlet 268*a* connected to the pressure line 264 and its outlet 268*b* connected through line 269 to a one revolution cycle control 271 for clutch 66. The clutch 66 may be of any suitable type which is operable, when actuated, to drive the output shaft 67 through one revolution. In the form diagrammatically shown in FIG. 23, the clutch is a pneumatic type having a pneumatic actuator 66*a* and fluid pressure from the regulator 262 is supplied to lines 272 and 273 and reservoir 274 to the pressure inlet 271*a* of the one revolution cycle control 271. The one revolution cycle control includes suitable valves and cams which are operable when a pressure pulse is applied to the cycle control inlet 271*b* to apply pressure through a line 271*c* to the pneumatic actuator for the clutch 66, to maintain the clutch engaged for one revolution of the shaft 67 and then disengage the clutch to stop the shaft 67. As previously described, the clutch shaft 67 is operable, when driven through one revolution, to drive the upper and lower jaw conveyors through a distance equal to the pitch distance of the jaw assemblies on the jaw conveyors. In addition, the clutch output shaft 67 is connected to sprocket 276, chain 277, and sprocket 278 to a timer shaft 279 to rotate the timer shaft through one revolution each time the clutch shaft is driven through one revolution.

The upper jaw conveyor 35 is moved to its lower operative position at the same time and preferably just prior to the time the clutch 66 starts advance of the jaw conveyors. As diagrammatically shown in FIG. 23, operation of the cylinders 241 for raising and lowering the upper jaw conveyor is controlled by a valve 281 having its inlet 281*a* connected to the pressure line 264 and controlled outlets 281*b* and 281*c* connected to relatively opposite ends of the cylinders 241. Valve 281 has one actuator 281*d* connected through a line 282 to a valve 283 operated by a cam 284 on the shaft 176*a* of the article ejector mechanism. Valve 283 is arranged to be operated during the initial movement of the article ejector mechanism to thereby control valve actuator 281*d* to move the valve to a position applying fluid pressure to the cylinders 241 to retract the actuators 241*a* and lower the upper clamp conveyor to the solid line position shown in FIG. 1. The clamp cylinders 241 are advantageously actuated to move the upper conveyor to its raised or inoperative position after the upper and lower jaw conveyors have traveled a preset distance corresponding to the desired length of package to be formed. The valve 281 has a second actuator 281*e* connected through a line 287 to a valve 288. Valve 288 is controlled by a cam 289 and the cam valve are relatively adjustable so as to vary the time during each drive cycle at which the valve 288 is actuated. As diagrammatically shown in FIG. 23, the cam 289 is mounted for rotation with one of the shafts, such as the lower jaw conveyor shaft 46*a*, which is rotated through one revolution when the jaw conveyor advances a distance corresponding to the pitch distance of the jaw assemblies thereon. Cam 289 is mounted for angular adjustment relative to the shaft 46*a* to enable selective adjustment of the time during each drive cycle which the valve 288 is operated. Provision is made for driving the inlet conveyor at a speed correlative with the speed of the upper and lower jaw conveyors, but only during that portion of the drive cycle in which the upper and lower jaw assemblies are pressed into clamping engagement with the wrapper to advance the same. In the embodiment disclosed, the clutch 158 for controlling driving of the inlet conveyor is of the electrical type and, as shown in FIG. 24, is energized through a full wave rectifier 295 under the control of a pressure switch 296. Fluid under pressure is applied to switch 296 under the control of valve 297 having its inlet port 297*a* connected to the pressure line 264 and a controlled outlet port 297*b* connected to the pressure switch. Valve 297 has one actuator 297*d* connected through a line 298 to a control valve 299 operated by a cam 301 on the cam shaft 279. Cam 301 is arranged so as to actuate valve 299 and hence operate the actuator 297*d* on valve 297 at the start of the drive cycle to start the clamp conveyor at substantially the same time as the upper and lower jaw conveyors commence movement. Valve 297 has a second actuator 297*e* connected through a line 302 to a control valve 303 operated by a cam 304. In order to facilitate adjustment of the time that valve 303 is operated and hence the time at which the inlet conveyor is stopped, cam 304 is conveniently mounted on one of the conveyor shafts such as shaft 46*a* and is angularly adjustable relative thereto to enable adjustment of the time during each drive cycle in which the inlet conveyor is stopped.

When utilizing the hot air type sealer 212, the flow of air to the heaters and hence to the nozzles 211 is controlled by a valve 306 having its inlet connected through a line 307 to the regulated pressure supply line 272 and its outlet connected through a line 308 and through a secondary pressure regulators 309 and lines 311 to the hot air heaters 212. Provision is made for operating valve 306 to supply air to the nozzles during the time that the wrapper is being advanced by the jaw conveyors and to interrupt the flow of air to prevent overheating and melting of the film when the advance to the wrappers is stopped. As previously described, the clamp cylinders 241 are operated to hold the upper jaw conveyor in its operative position during only a portion of each drive cycle to control the length of packages to be formed and the actuator 306*a* for valve 306 is conveniently connected through a line 313 to the controlled outlet port 281*c* of valve 281. Thus, valve 306 is operated to its on condition during the time valve 281 is operated to lower the upper jaw conveyor 35.

Positioning of the articles in the wrapper is controlled by the stop fingers 191 operated by cylinder 195. Cylinder 195 is reversibly operated under control of a valve 320 having an inlet 320*a* connected through the pressure line 264 and control outlets 320*b* and 320*c* connected to relatively opposite ends of the cylinder. Valve 320 has actuators 320*d* and 320*e* connected through lines 321 and 322 to valves 323 and 324 operated under the control of cams 325 and 326. Cams 325 and 326 are also driven through one revolution during each cycle of the machine and, in order to facilitate adjustment of the cams and the timing of the operation of the article stops, the cams are conveniently mounted on one of the shafts such as the conveyor shaft 45*c* to be driven thereby through one revolution during each drive cycle.

The cut off of air to the hot air heaters 212 for an extended period of time could cause overheating and provision is made for raising the heaters, if there is an excessive delay between successive cycles of the machine. The cylinder 214 for raising the hot air nozzles is controlled by a valve 328 having its inlet 328*a* connected to the pressure line 264 and controlled outlets 328*b* and 328*c* connected through the cylinder 214. Valve 328 has an electrical responsive actuator 328*d*. The valve 328 is normally positioned so as to apply pressure to the cylinders 214 to raise the heaters 212 and nozzles 211 and the actuator 328*d* is operative, when energized, to effect lowering of the nozzles and heaters. As schematically shown in FIG. 24, the electroresponsive actuator 328*d* is energized under the control of normally open motor start switch contacts 330*a* and normally closed time delay relay contacts 331*a*. The time delay relay contacts 331*a* are operated by a time delay relay 331 controlled by a pressure switch 335, which pressure switch is normally closed and which is opened during each drive cycle. As shown in FIG. 23, switch 335 is conveniently connected to the line 271*c* from the one revolution clutch control 271 so that the pressure switch 335 is opened during each drive cycle and then closed at the end of the drive cycle. If the machine is not again cycled within a predetermined time interval determined by the time delay relay 331, relay 331 opens contacts 331*a* and deenergizes the actuator 328*d* to allow the heat cylinder to move to its raised position.

Provision is made for reestablishing the flow of air to the nozzles 211 when the nozzles are raised, to prevent overheating of the hot air heaters 212. This is conveniently achieved by a line 291 that connects the controlled outlet port 328*c* of valve 328 with the exhaust port 281*f* of valve 281. Exhaust port 281*f* of valve 281 communicates with control port 281*c* and hence with the line 313, when valve 281 is positioned to exhaust pressure from its controlled port 281*c*. Thus, when valve 328 is actuated to apply pressure to its controlled outlet 328*c*, pressure is also applied through line 291 to the exhaust outlet port 281*f* and through valve 281 and its controlled outlet 281*c* to line 313 to pressurize valve actuator 306*a* and turn valve 306 on.

The main drive motor 61 is controlled by a motor relay 330 and, as shown in FIG. 24, the motor relay is energized under the control of a normally open start switch 341*b*, a normally closed stop switch 342*b* and the contacts 343*a* of a control relay 343. The control relay 343 is itself energized under the control of a normally open start switch 341*a* and a normally closed stop switch 342*a* and the relay 343, when energized, closes contacts 343*a* and also closes contacts 343*b* to establish a holding circuit in parallel with the start switch to maintain the relay energized. Motor relay 330 also controls contacts 330*a* connected in series with normally open pressure switch 332 and in parallel with the normally open start switch 341*b* to establish a holding circuit for the motor start relay 330, if the pressure switch 332 is closed. As shown in FIG. 23, pressure switch 332 is connected in the main pneumatic pressure line 264 and is closed only when there is sufficient air pressure in the line. Energization of the heater 111 in the sealing bar is controlled by a relay 111*a* and energization of the heaters 212 is controlled by a relay 212*a* and the relays 111*a* and 212*a* are selectively energized under the control of a manually operable on-off switch 349. A sealing bar temperature control 350 having a thermocouple 350*a* for sensing the sealing bar temperature and an adjustable temperature control 350*b*, is provided for controlling the heating bar temperature.

Operation

From the foregoing it is felt that the construction and operation of the wrapping machine will be readily understood. At the beginning of each drive cycle, the upper jaw conveyor is in its raised position shown in FIGS. 8 and 21 with a pair of upper and lower jaw assemblies 57, 47 disposed in opposed relation adjacent the inlet end of the upper and lower jaw conveyors. The machine is operated through a drive cycle each time the trip switch 261 is operated by the machine M that feeds articles to the wrapping material. When the trip switch 261 is actuated, the article ejector mechanism 175 is operated, that is moved forwardly as indicated at 176*f* in FIG. 22, to deposit the articles on the wrapper and the article ejector remains in its forward position until retracted as indicated at 176*r*. During the initial forward movement of the article ejector, the upper jaw conveyor operating ejector mechanism, cylinders 241 are operated under the control of cam 284 on article ejector shaft 176*a* to lower the upper jaw conveyor to clamp the wrapper therebetween as indicated at 35L. The clutch 66 is energized shortly thereafter as indicated at 66*e* and this starts advance of the upper and lower jaw assemblies, as indicated at 34*s*. Valve 306 is operated to supply air to the nozzles 211 of the hot air sealer to form a longitudinal seal in the wrapper as it is advanced by the upper and lower jaw conveyors. In addition, the clutch for the inlet conveyor is energized to drive the inlet conveyor at substantially the same speed as the upper and lower jaw conveyors. The clutch operates to drive the shaft 67 and is disengaged at the end of one revolution as indicated at 66*d* under the control of the clutch cycle control 271. The drive train from clutch shaft 67 to the jaw conveyors is arranged to advance the upper and lower jaw conveyors a distance designated PD equal to the pitch distance of the jaw assemblies on the upper and lower jaw conveyors, when clutch shaft 67 is rotated through one revolution, and the jaw conveyors then stop as indicated at 34*e* when the clutch is disengaged. After the upper and lower conveyors have traveled through a portion of the drive cycle and the upper and lower jaw assemblies have advanced a distance FD corresponding to the desired length of the package to be formed, the upper and lower jaw assemblies are separated as indicated at 35*r* either by passing beyond the end of the adjustable upper guide rails 82 in the embodiment of FIGS. 1–20 or by raising of the upper jaw conveyor in the embodiment of FIG. 21, to thereby release the wrapper and interrupt advance of the strip. At the same time, the hot air to the nozzles is shut off as indicated at 211*e* to prevent overheating and burning of the wrapper and the inlet conveyor is also shut off as indicated at 131*e* to interrupt the advance of the inlet conveyor. The article stop fingers 191 are operated during each drive cycle between the raised position 191*r* and a lower position 191*l* under the control of cams 325 and 326 to locate the articles in the wrapper so that they will be in proper position when they reach the transverse sealing station D. The time during each drive cycle at which the upper and lower jaw assemblies are released from clamping engagement with the wrapper (34*r*) and the time at which the inlet conveyor is stopped (131*e*) and the hot air is shut off (211*e*) is selectively adjustable to adjust the length of the packages to be formed. For example, the pitch distance can be about 10 inches and the feed distance designated Fd can be adjustable from about 3 inches to 9 inches.

The heat sealing and cutting member 101 operates to transversely sever and seal the wrappers at opposite sides of the line of severance, while the wrappers are clamped between the upper and lower jaw assemblies, so that the separated packages can continue to advance with the lower jaw conveyor after the upper and lower jaw assemblies are separated and interrupt advance of the wrapper. The support bars on the lower jaw conveyor underlie and support the separated articles to convey the same to the discharge end of the conveyor.

The inlet clamp conveyor is operated to clamp the wrapper against the articles after they have been deposited in the wrapper to hold the articles in position and advance the same with the wrapper and the inlet conveyor clamps are operated to release the wrapper at the outlet end of the inlet conveyor. The clamp mechanism on the inlet conveyor is laterally adjustable to accomodate articles of different widths and the article chutes are also laterally adjustable to adapt the same for handling different size articles.

When handling thin film, particularly stretchable plastic, the rotary brushes 201*a* and 201*b* are advantageously used to draw the edges of the wrapper into overlapping relation prior to longitudinal sealing. When relatively non-stretchable wrapping material is used, such as paper or foil, folding and sealing plows such as shown at 231, 232 and 235 can be used to guide the edges of the wrapper into abutting face-to-face relation and to heat seal the same.

The embodiments of the invention in which an exclusive property or privilege is claimed are defined as follows:

1. In a machine for wrapping articles in an elongated strip of wrapping material and for sealing and severing the strip between adjacent articles to form separate packages, the machine including means for depositing articles on the strip at a loading station, means for folding the strip into a tube around the articles and for sealing the edges of the enfolded tube together as the strip is advanced lengthwise along a generally horizontal path past a longitudinal sealing station, endless type upper and lower jaw conveyor means having adjacent runs thereof extending lengthwise of said path, and upper and lower jaw assemblies on the respective upper and lower jaw conveyor means extending transverse thereto and spaced apart therealong a preselected distance to move in opposed pairs as the upper and lower jaw assemblies move along said adjacent runs thereof, the improvement comprising: said upper and lower jaw assemblies being spaced apart along the respective upper and lower conveyor means a pitch distance at least as long as the length of the maximum size package to be formed, main drive means operable to drive said lower and upper jaw conveyor means through a drive cycle to advance the respective upper and lower jaw assemblies at the same linear speed along the adjacent runs thereof through a distance equal to said pitch distance, adjustably presettable jaw operating means operative to press the opposed pairs of upper and lower jaw assemblies into clamping engagement with the tube during a preset portion of the drive cycle as they advance along the adjacent runs of the upper and lower jaw conveyor means a preset distance substantially less than said pitch distance to clamp the tube therebetween and advance the tube therewith a distance corresponding to said preset distance and to thereafter release the opposed pair of upper and lower jaw assemblies from clamping engagement with the tube to interrupt advance of the tube, and means for severing and sealing the tube at opposite sides of the line of severance while the tube is clamped between an opposed pair of the upper and lower jaw assemblies.

2. A machine for wrapping articles according to claim 1 wherein said lower jaw conveyor means has means movable therewith adapted to underlie and support the packages after severance from the tube.

3. A machine for wrapping articles according to claim 1 wherein said lower jaw assemblies each include a pair of clamping jaw members extending crosswise of the article path and spaced apart in a direction lengthwise of the article path to define a jaw opening therebetween, a sealing and cutting member extending crosswise of the article path and mounted for movement in a closed loop course extending generally tangent to said path, and means for driving said sealing and cutting member in timed relation with lower jaw conveyor means along said closed loop course sequentially into the jaw opening in the lower jaw assembly while said upper and lower jaw assemblies are pressed into clamping engagement with the tube to sever the tube and seal the tube at opposite sides of the severance and then out of said opening in the lower jaw assembly before the upper and lower jaw assemblies are released.

4. A machine for wrapping articles according to claim 3 wherein said sealing and cutting member includes means for heating the same for heat sealing the tube of wrapping material.

5. A machine for wrapping articles according to claim 3 wherein said sealing and cutting member includes a sharpened cutting element extending lengthwise thereof for severing the tube and a pair of flat sealing faces along opposite sides of the cutting element, said upper jaw assemblies each including a pair of flat cooperable with said flat sealing faces on the sealing and cutting member to clamp the tube therebetween, and a recess in each upper jaw assembly intermediate the pair of flat sealing faces thereon to receive the cutting element on the sealing and cutting member.

6. A machine for wrapping articles according to claim 5 wherein said cutting element has a toothed cutting edge with one side of each tooth extending generally perpendicular to the length of the element and the other side of each tooth inclined at an acute angle to the length of the element.

7. A machine for wrapping articles according to claim 1 wherein said adjustably presettable jaw operating means includes jaw hold-down bars extending lengthwise of the path of travel of said upper jaw assemblies as they advance along said adjacent run, and means for selectively adjusting the effective length of said hold-down bars to adjust said preset distance.

8. A machine for wrapping articles according to claim 1 wherein said upper jaw conveyor means is mounted for shifting movement between a lowered and a raised position, said adjustably presettable jaw operating means including means operated in timed relation with said upper jaw conveyor means for moving said upper jaw conveyor means to its lower position and for thereafter moving the upper jaw conveyor means to its raised position.

9. A machine for wrapping a tube according to claim 1 including an endless type inlet conveyor means having upper run extending between said loading station and said lower jaw conveyor means and adapted to underlie and support the strip and the articles deposited thereon, and means for driving said inlet conveyor means at the linear speed of the lower jaw conveyor means during said preset portion of the drive cycle to advance the upper run thereof a distance corresponding to said preset distance.

10. A machine for wrapping articles according to claim 9 wherein said inlet conveyor means includes means for gripping the outer sides of the strip of wrapping material to hold the article in position therein as the strip is advanced along the inlet conveyor means.

11. A machine for wrapping articles according to claim 1 including an endless type inlet conveyor means having an upper run extending between said loading station and said lower jaw conveyor means, said inlet conveyor means including a plurality of slats of extending crosswise of the inlet conveyor means to underlie and support the strip of wrapping material, a first set of said slats being mounted for limited movement in a direction crosswise of the inlet conveyor means and each having a first clamp member extending transverse thereto for engaging the strip of wrapping material at one side of the articles therein, a second set of said slats being mounted for limited movement in a direction crosswise of the inlet conveyor means and each having a second clamp member extending transverse thereto for engaging the strip of wrapping material at the other side of the articles therein, and means for relatively moving said slats of the first and second sets in a direction crosswise of the inlet conveyor means to clamp the strip and the articles therein as they advance along at least a portion of said upper run of the inlet conveyor means.

12. A machine for wrapping articles according to claim 11 wherein said means for relatively moving the first and second sets of slats includes means operative to laterally spread the first and second clamps apart adjacent the inlet end of the inlet conveyor means and to move the first and second clamp members against opposite sides of the strip of wrapping material as the slats move along at least a portion of the upper run of the inlet conveyor means.

13. A machine for wrapping articles according to claim 11 wherein said means for relatively moving said slats of the first and second sets includes spring means yieldably urging the slats of the first and second sets in relatively opposite directions to normally bias the first and second clamp members toward each other and clamp the strip of wrapping material therebetween, and cam means adjacent at least the inlet end of the inlet conveyor means for relatively moving the slats of the first relatively and second sets in a direction to laterally separate the first and second clamp member.

14. A machine for wrapping articles according to claim 11 including means for driving said inlet conveyor means at a linear speed correlative with that of the lower jaw conveyor means during said preset portion of the drive cycle to advance the upper run thereof a distance correlative with said preset distance.

15. A machine for wrapping articles according to claim 1 including an endless type inlet conveyor means having an upper run extending between said loading station and said lower jaw conveyor means, means for driving said inlet conveyor means at a linear speed correlative with that of the lower jaw conveyor means during said preset portion of the drive cycle to advance the upper run thereof a distance correlative with said preset distance, said inlet conveyor means including spaced endless chains having first and second sets of enlongated slats extending between the chains in alternate succession and mounted for limited movement relative to the chains in a direction crosswise thereof, the slats of the first and second sets respectively having first and second clamp members extending transverse thereto for engaging strip of wrapping material at relatively opposite sides of the articles therein, spring means connected to adjacent slats of the first and second sets for urging the same in relatively opposite directions to bias the clamp members thereon toward each other to a clamp position, and cam means disposed alongside the path of travel of the slats for relatively moving the slats in a direction to shift the first and second clamp members away from each other to a release position as the slats move along a portion of the upper run thereof.

16. A machine for wrapping articles according to claim 15 wherein each of said slats of said first set have a first cam follower thereon and each of said slat of said second set have a second cam follower thereon, said cam means including first and second cam tracks extending lengthwise of at least a portion of said upper run of the inlet conveyor means, and means mounting said first and second cam tracks for adjustment in a direction crosswise of the conveyor means to adapt the machine for wrapping articles of different width.

17. A machine for wrapping articles according to claim 1 wherein said means for folding the wrapper into a tube around the articles includes a pair of rotary members mounted for rotation about axes generally parallel to and laterally offset at relatively opposite sides of the center of the wrapper at locations such that the peripheries of the rotary members engage the enfolded tube of wrapping material at the top of the articles therein, and means for rotating the rotary members in relatively opposite directions to urge the edges of the enfolded tube into overlapping relation.

18. A machine for wrapping articles according to claim 17 wherein said means for sealing the edge of the enfolded tube includes means for directing a jet of heated air against the overlapping edges of the enfolded tube.

19. In a multiple lane wrapping machine for simultaneously wrapping a plurality of articles in a corresponding plurality of strips of wrapping material and for sealing and severing the strips between the articles to form separate packages, the machine including means for depositing articles in the strips at a loading station, means for folding the strips into tubes around the articles and for sealing the edges of the enfolded tubes together as the strips are advanced lengthwise along a generally horizontal path, transverse sealing and feed means including upper and lower sealing bar assemblies extending crosswise of said path, and drive means for cyclically moving opposed pairs of said upper and lower jaw assemblies sequentially into gripping engagement with the enfolded tubes and then forwardly along the path to draw the enfolded tubes therewith and thereafter away from each other out of gripping engagement with the enfolded tubes to interrupt advance of the enfolded tubes, the improvement comprising: laterally spaced endless feed chains each having an upper run generally paralleling said path and extending from the loading station to the transverse sealing and feed means, first and second sets of slats extending between the feed chains in alternate succession and mounted for limited movement relative to the feed chains in a direction crosswise thereof, the slats of the first and second sets respectively having first and second clamp members extending transverse thereto for engaging the strips of wrapping material at relatively opposite sides of the articles therein, and means for relatively moving the slats of the first and second sets in a direction crosswise of the direction of advance of the feed chains to clamp the strips against the articles therein as they advance along at least a portion of the upper run of said spaced feed chains, and means for driving said endless feed chains to advance the upper run thereof while said upper and lower jaw assemblies move forwardly along the path.

20. A multiple lane wrapping machine according to claim 19 wherein said means for relatively shifting the said first and second sets of slats includes spring means yieldably urging the slats of the first and second sets in relatively opposite directions to normally bias the first and second clamp members toward each other and clamp the strips of wrapping material to the articles, and cam means adjacent at least the inlet end of the endless feed chains for relatively moving the slats of the first and second sets in a direction to laterally separate the first and second clamp members.

21. A machine for wrapping articles according to claim 20 wherein the slats of said first and second sets respectively have first and second cam followers thereon, said cam means including first and second cam tracks extending lengthwise of at least a portion of said upper run of said endless chains, and means mounted said first and second cam tracks for adjustment in a direction crosswise to the direction of advanced of the slats to adapt the machine for wrapping articles of different width.

22. A multiple lane wrapping machine according to claim 19 wherein said transverse sealing and feed means includes upper and lower endless jaw conveyor means having adjacent runs thereof extending lengthwise of said path, the upper and lower jaw conveyor means respectively having upper and lower jaw assemblies spaced apart therealong a pitch distance greater than the length of the maximum size package to be formed, said drive means including means operable to drive said upper and lower endless jaw conveyor means through a drive cycle to advance the upper and lower jaw asemblies at the same linear speed along the adjacent runs thereof a distance equal to said pitch distance, adjustably presettable jaw operating means operative to press opposed pairs of said upper and lower jaw assemblies into clamping engagement with the tubes during a preset portion of the drive cycle as they advance along the adjacent runs of the upper and lower jaw conveyor means a preset distance substantially less than said pitch distance to clamp the tubes therebetween and advance the tubes therewith a distance corresponding to said preset distance and to thereafter release the opposed pairs of upper and lower jaw assemblies for clamping engagement with the tubes to interrupt advance of the tubes, and means for severing and sealing the tubes at opposite sides of the line of severance while the tubes are clamped between opposed pairs of upper and lower jaw assemblies.

23. A machine for wrapping articles according to claim 22 wherein lower jaw conveyor means has means movable therewith adapted to underlie and support the packages after severance from the tube.

24. A multiple lane wrapping machine according to claim 19 wherein said means for folding the strips into tubes includes a pair of rotary members individual to each lane and mounted for rotation about axes generally parallel to and offset at relatively opposite sides of the center of the respective lane at locations such that the peripheries of the rotary members engage the enfolded tube of wrapping material at the top of the particles therein, and means for rotating each pair of rotary members in relatively opposite directions to urge the edges of the enfolded tubes into overlapping relation.

25. A multiple lane wrapping machine according to claim 23 wherein said means for sealing the edges of the enfolded tubes together includes means for directing a jet of heated air against the overlapping edges of the enfolded tubes.

26. In a machine for wrapping articles in an enlongated strip of wrapping material and for sealing and severing the strip between adjacent articles to form separate packages, the machine including endless type inlet and outlet conveyor means having upper runs thereof disposed in end-to-end relation to underlie and support a strip of wrapping material, means adjacent one end of the inlet conveyor means for feeding articles onto the strip, means disposed above the inlet conveyor means for folding and seaming the strip into a tube around the articles, an upper conveyor means having a lower run adjacent the upper run of the outlet conveyor means, said outlet and upper conveyor means respectively having lower and upper jaw assemblies extending transverse to the direction of movement thereof and spaced apart therealong to move in opposed pairs as the upper jaw assembly moves along its lower run, the improvement comprising: said lower and upper jaw assemblies being spaced apart along the respective outlet and upper endless conveyor means a pitch distance substantially greater than the length of the maximum size package to be formed, main drive means operable to drive said outlet and upper endless conveyor means through a drive cycle to advance the respective lower and upper jaw assemblies at the same linear speed along the adjacent runs thereof through a distance equal to said pitch distance, selectively presettable jaw operating means operative to press opposed pairs of upper and lower jaw assemblies into clamping engagement with the tube during a preset portion of the drive cycle as they advance along the adjacent runs of the outlet and upper endless conveyors a preset distance substantially less than said pitch distance to clamp the tube therebetween and advance the tube therewith a distance equal to said preset distance, means for severing and sealing the tube at opposite sides of the line of severance while the tube is clamped between the upper and lower jaw assemblies, and means for driving said inlet endless conveyor means at the linear speed of the outlet endless conveyor means during said preset portion of the drive cycle.

27. A machine for wrapping articles according to claim 26 wherein said inlet conveyor means includes means for gripping the outer sides of the wrapper to hold the articles in position therein as the wrapper is advanced along the inlet endless conveyor means.

28. A machine for wrapping articles according to claim 26 wherein said inlet conveyor means includes first and second sets of slats extending crosswise of the inlet conveyor means and mounted for limited movement relative thereto in a direction crosswise of the inlet conveyor means, a first clamp member extending transverse to each of the slats of the first set to engage the wrapper at one side of the articles therein and a second clamp member extending transverse to each of the slats of the second set to engage the wrapper at the other side of the articles therein.

29. A machine for wrapping articles according to claim 26 wherein said inlet conveyor means includes first and second sets of slats extending crosswise of the inlet conveyor means and mounted for limited movement relative thereto in a direction crosswise of the inlet conveyor means, a first clamp member extending transverse to each of the slats of the first set to engage the wrapper at one side of the articles therein and a second clamp member extending transverse to each of the slats of the second set to engage the wrapper at the other side of the articles therein, and means for relatively shifting the slats of the first and second sets to spread the first and second clamp members apart adjacent the inlet end of the inlet conveyor means and to move the first and second clamp members against opposite sides of the wrapper as the slats move along an intermediate portion of the upper run of the inlet conveyor means.

30. A machine for wrapping articles according to claim 26 wherein said inlet conveyor means includes first and second sets of slats extending crosswise of the inlet conveyor means and mounted for limited movement relative thereto in a direction crosswise of the inlet conveyor means, a first clamp member extending transverse to each of the slats of the first set to engage the wrapper at one side of the articles therein and a second clamp member extending transverse to each of the slats of the second set to engage the wrapper at the other side of the articles therein, means yieldably urging said first and second sets of slats in relatively opposite directions to normally bias the first and second clamp members toward each other and against opposite sides of the wrapper, and cam means adjacent at least the inlet end of said inlet conveyor means for relatively moving said first and second sets of slats in directions to separate said first and second sets of clamp members.

31. A machine for wrapping articles according to claim 30 wherein said means for folding and seaming the strip into a tube around the articles includes a pair of rotary members mounted for rotation about axes generally parallel to and offset at relatively opposite sides of the center of the enfolded tube at locations such that the peripheries of the rotary members engage the enfolded tube at the top of the articles therein, means for rotating each pair of rotary members in relatively opposite directions to urge the edges of the enfolded tube into overlapping relation and means for directing a jet of heated air against the overlapping edges of the enfolded tube as it is advance.

32. In a multiple lane wrapping machine for simultaneously wrapping a plurality of articles in a corresponding plurality of strips of wrapping material and for sealing and severing the strips between the articles to form separate packages, the machine including means for depositing articles in the strips at a loading station, means for folding the strips into tubes around the articles and for sealing the edges of the enfolded tubes together as the strips are advanced lengthwise along a generally horizontal path, transverse sealing and feed means including upper and lower jaw assemblies extending crosswise of said path, and drive means for cyclically moving opposed pairs of said upper and lower jaw assemblies sequentially into gripping engagement with the enfolded tubes and then forwardly along the path to draw the enfolded tubes therewith and thereafter away from each other out of gripping engagement with the enfolded tubes to interrupt advance of the enfolded tubes, the improvement wherein said means for folding the strips into tubes and for sealing the edges of the enfolded tubes includes a pair of rotary brush members individual to each lane and mounted for rotation about axes generally parallel to and offset at relatively opposite sides of the center of the respective lane at locations such that the peripheries of the rotary brush members engage the enfolded tube of wrapping material at the top of the articles therein, said rotary brush members each including a hub and resilient brush means extending outwardly from the hub, a drive shaft extending crosswise of the multiple lane wrapping machine at a level above the rotary brush members, and a plurality of belts extending over said drive shaft and each twisted to extend under a respective one of the hubs in a manner to rotate each pair of rotary brush members in relatively opposite directions to urge the edges of the enfolded tubes into overlapping relation, and means for directing a jet of heated air against the overlapping edges of the enfolded tubes.

33. A multiple lane wrapping machine according to claim 32 wherein the rotary members of each pair are spaced apart in a direction lengthwise of the respective lane.

* * * * *

UNITED STATES PATENT AND TRADEMARK OFFICE

CERTIFICATE OF CORRECTION

PATENT NO. : 4,004,400

DATED : January 25, 1977

INVENTOR(S) : Ralph F. Anderson et al

It is certified that error appears in the above-identified patent and that said Letters Patent are hereby corrected as shown below:

Column 20, line 14, -- sealing faces -- should be added before "cooperable";
Column 20, line 60, delete the word "of" (second occurrence);
Column 21, line 64, "slat" should be -- slats --;
Column 23, line 7, "mounted" should be -- mounting --;
Column 23, lines 50 and 51, "particles" should be -- articles--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*